US005612174A

United States Patent [19]

Takizawa et al.

[11] Patent Number: 5,612,174

[45] Date of Patent: Mar. 18, 1997

[54] PHOTOGRAPHIC YELLOW DYE-FORMING COUPLERS AND SILVER HALIDE COLOR PHOTOGRAPHIC MATERIALS CONTAINING THE SAME

[75] Inventors: Hiroo Takizawa; Yasuhiro Yoshioka; Masakazu Morigaki, all of Ashigara, Japan

[73] Assignee: Fuji Photo Film Co., Ltd., Kanagawa, Japan

[21] Appl. No.: 568,488

[22] Filed: Dec. 7, 1995

[30] Foreign Application Priority Data

Dec. 7, 1994 [JP] Japan ..... 6-330333

[51] Int. Cl.[6] ..... G03C 1/08; G03C 7/26; G03C 7/32

[52] U.S. Cl. ..... 430/557; 430/556; 430/543; 430/546; 430/551; 430/502; 430/503

[58] Field of Search ..... 430/502, 503, 430/557, 556, 543, 546, 551

[56] References Cited

U.S. PATENT DOCUMENTS

| | | | |
|---|---|---|---|
| 5,066,574 | 11/1991 | Kubota et al. | 430/557 |
| 5,215,877 | 6/1993 | Tomotake et al. | 430/557 |
| 5,399,474 | 3/1995 | Tomotake et al. | 430/557 |

*Primary Examiner*—Geraldine Letscher
*Attorney, Agent, or Firm*—Birch, Stewart, Kolasch & Birch, LLP

[57] ABSTRACT

Disclosed are a photographic yellow dye-forming coupler of formula (I) and a photographic material containing one or more such yellow couplers.

(I)

wherein $R_1$ represents an alkyl group, a cycloalkyl group, an aryl group, an alkylamino group, an anilino group, or a heterocyclic group; $R_2$ represents a hydrogen atom, a halogen atom, an aliphatic-oxy group, an aryloxy group, an aliphatic group, or an amino group; $R_3$ represents an alkenyl group; $R_4$ represents a substituent; m represents an integer of from 0 to 3; and X represents a hydrogen atom, or a group capable of being split off from the formula by the coupling reaction with an oxidation product of an aromatic primary amine developing agent. The couplers have a high solubility in solvents, and emulsions containing the couplers can be stored in cool for a long period of time without worsening the coloring property of the couplers.

22 Claims, No Drawings

PHOTOGRAPHIC YELLOW DYE-FORMING COUPLERS AND SILVER HALIDE COLOR PHOTOGRAPHIC MATERIALS CONTAINING THE SAME

FIELD OF THE INVENTION

The present invention relates to novel photographic yellow dye-forming couplers and to silver halide color photographic materials containing them.

BACKGROUND OF THE INVENTION

A silver halide color photographic material is, after having been exposed, subjected to color development, by which the dye-forming couplers (hereinafter referred to as "couplers") existing in the material are reacted with the oxidized, aromatic primary amine developing agent to form a color image on the material. In general, the color reproduction to be conducted by this method comes into the category of subtractive color photography, in which yellow, magenta and cyan color images which are complementary to blue, green and red, respectively, are formed to reproduce the colors. In general, yellow dye-forming couplers (hereinafter referred to as "yellow couplers") of acylacetamide couplers and malondianilide couplers are used for forming yellow color images, magenta couplers of 5-pyrazolone couplers and pyrazolotriazole couplers are used for forming magenta color images, and cyan couplers of phenol couplers and naphthol couplers are used for forming cyan color images.

By processing silver halide color photographic materials, in general, yellow dyes, magenta dyes and cyan dyes are formed from couplers, such as those mentioned above, in the silver halide emulsion layers sensitive to radiations complementary to the radiations to be absorbed by the dyes or in the layers adjacent to the color-sensitive layers. As the yellow couplers, especially those for forming photographic images, generally employed are acylacetamide couplers such as typically benzoylacetanilide couplers and pivaloylacetanilide couplers. The former generally have a high coupling activity with the oxidation products of aromatic primary amine developing agents during development and the yellow dyes to be formed from them have a large molecular extinction coefficient. Therefore, they are used mainly in color photographic materials for photographing, especially color negative films which are required to have a high sensitivity. The latter form yellow dyes having excellent spectral absorption characteristics and high fastness and are therefore used mainly in color papers and color reversal films.

Recently, it is desired to provide low-priced silver halide color photographic materials by using inexpensive couplers. However, couplers made from low-priced raw materials had drawbacks in that their color-forming properties are poor and, in addition, the cold storage stability of emulsions comprising them is poor since their solubility in high boiling point organic solvents is low. In particular, those having satisfactory color-forming properties have a low solubility in high boiling point organic solvents and therefore their emulsions have poor storage stability, while those having a satisfactorily high solubility in such solvents have poor color-forming properties. In addition, the dyes to be formed from these couplers have insufficient color image fastness. Therefore, the development of couplers of forming dyes with high fastness has been desired.

SUMMARY OF THE INVENTION

An object of the present invention is to provide yellow dye-forming couplers with excellent color-forming properties and silver halide color photographic materials containing them.

Another object of the present invention is to provide yellow dye-forming couplers having a high solubility in organic solvents, of which the emulsions have good cold storage stability, and also silver halide color photographic materials containing them.

A further object of the present invention is to provide yellow dye-forming couplers which form color images having good fastness to light, heat and temperature, and also silver halide color photographic materials containing them.

Still another object of the present invention is to provide yellow dye-forming couplers which can be made from naturally-existing, low-priced raw materials, and also silver halide color photographic materials containing them.

The above-mentioned objects of the present invention have been attained by the following:

(1) A photographic yellow dye-forming coupler (hereinafter simply referred to as an yellow coupler) to be represented by the following formula (I), and (2) a silver halide color photographic material containing at least one such yellow coupler in at least one layer formed on a support.

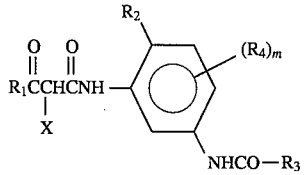

(I)

wherein $R_1$ represents an alkyl group, a cycloalkyl group, an aryl group, an alkylamino group, an anilino group, or a heterocyclic group; $R_2$ represents a hydrogen atom, a halogen atom, an aliphatic-oxy group, an aryloxy group, an aliphatic group, or an amino group; $R_3$ represents an alkenyl group; $R_4$ represents a substituent; m represents an integer of from 0 to 3; and X represents a hydrogen atom, or a group capable of being split off from the formula by the coupling reaction with an oxidation product of an aromatic primary amine developing agent.

(3) The yellow coupler according to the foregoing (1) and the silver halide color photographic material according to the foregoing (2), in which $R_3$ in the yellow coupler of formula (I) is represented by the following formula (II)

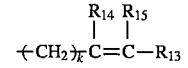

(II)

wherein $R_{13}$ represents a hydrogen atom, an alkyl group, or an alkenyl group; $R_{14}$ and $R_{15}$ each independently represents a hydrogen atom, a chlorine atom, or a bromine atom; and k represents an integer of from 3 to 11.

(4) The yellow coupler according to the foregoing (1) or (3) and the silver halide color photographic material according to the foregoing (2) or (3), in which X in the yellow coupler of formula (I) is represented by the following formula (III-1)

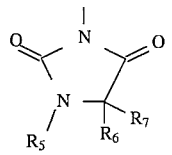

(III-1)

wherein $R_5$, $R_6$ and $R_7$ each independently represent a hydrogen atom, or an alkyl group having from 1 to 4 carbon atoms.

DETAILED DESCRIPTION OF THE INVENTION

Yellow couplers of formula (I) of the present invention are described in detail hereinunder.

Unless otherwise specifically indicated, the aliphatic moiety in the aliphatic group and the aliphaticoxy group as referred to herein may be linear, branched or cyclic and may contain unsaturated bond(s) and may be substituted by any known substituent(s) which may be in ordinary yellow couplers. Concretely, the aliphatic group as referred to herein includes alkyl, alkenyl, alkynyl and cycloalkyl groups, etc.

Unless otherwise specifically indicated, the alkyl moiety in the alkyl, alkenyl and alkylamino groups as referred to herein may be linear, branched or cyclic and may be substituted by any known substituent(s) which may be in ordinary yellow couplers.

Unless otherwise specifically indicated, the cycloalkyl group as referred to herein may be condensed to form a condensed ring and may be substituted by any known substituent(s) which may be in ordinary yellow couplers.

Unless otherwise specifically indicated, the aryl moiety in the aryl group, the heterocyclic group and the aryloxy group as referred to herein may be condensed to form a condensed ring and may be substituted by any known substituent(s) which may be in ordinary yellow couplers.

Unless otherwise specifically indicated, the phenyl moiety and the N-position in the anilino group as referred to herein may be substituted by any known substituent(s) which may be in ordinary yellow couplers.

Unless otherwise specifically indicated, the amino group as referred to herein may be substituted by any known substituent(s) which may be in ordinary yellow couplers.

Where the coupler compound of the present invention contains a geometrical isomer due to unsaturated bonds, etc., it may be in the form of its single isomer or a mixture of its plural isomers.

In formula (I), $R_1$ is preferably an alkyl group having from 1 to 30 carbon atoms (hereinafter referred to as C atoms) (e.g., methyl, ethyl, i-propyl, t-butyl, t-pentyl, octyl, benzyl), a cycloalkyl group having from 3 to 30 C atoms (e.g., cyclopropyl, 1-methylcyclopropyl, 1-ethylcyclopropyl, 1-benzylcyclopropyl, cyclopentyl, 1-methylcyclohexyl, cyclohexyl), an aryl group having from 6 to 36 C atoms (e.g., phenyl, 2-naphthyl, 4-methylphenyl, 4-methoxyphenyl, 3-acetylaminophenyl, 2-chlorophenyl), a heterocyclic group having from 1 to 30 C atoms (e.g., indolinyl, 3,5-dioxanyl, 1-methyl-3,5-dioxanyl), an alkylamino group having from 1 to 30 C atoms (e.g., N-methylamino, N,N-dimethylamino), or an anilino group having from 6 to 36 C atoms (e.g., anilino, N-methylanilino); more preferably an alkyl group, a cycloalkyl group, an aryl group or a heterocyclic group; even more preferably a t-butyl group, a 1-methylcylopropyl group, a 1-ethylcyclopropyl group, a 1-benzylcylcloproply group, a 4-methoxyphenyl group or an indolinyl group; especially more preferably a t-butyl group, a 1-ethylcyclopropyl group or a 4-methoxyphenyl group; and most preferably a t-butyl group.

In formula (I), $R_2$ is preferably a hydrogen atom, a halogen atom (e.g., fluorine, chlorine, bromine, iodine), an aliphatic-oxy group having from 1 to 30 C atoms (e.g., methoxy, i-propoxy, t-butoxy, benzyloxy, cyclohexyloxy), an aryloxy group having from 6 to 36 C atoms (e.g., phenoxy, 2-naphthoxy, 4-methoxyphenoxy, 2-chlorophenoxy), an aliphatic group having from 1 to 30 C atoms (e.g., methyl, i-propyl, t-butyl, benzyl, trifluoromethyl, cyclohexyl), or an amino group having from 0 to 30 C atoms (e.g., N,N-dimethylamino, N-cyclohexylamino, N-butylamino), more preferably it is a halogen atom, an aliphatic-oxy group or an aryloxy group, even more preferably it is a chlorine atom or a methoxy group, and most preferably it is a chlorine atom.

In formula (I), $R_3$ is an alkenyl group which may be substituted or unsubstituted and may be linear or branched. The substituents for the substituted alkenyl group may be any known substituents which may be in ordinary yellow couplers, including, for example, a hydroxyl group, an amino group, an alkylamino group, an anilino group, an alkoxy group, a halogen atom, etc. Preferred are a chlorine atom, a bromine atom and a hydroxyl group. Where the alkenyl group is substituted by a chlorine atom or a bromine atom, the substituent atom is preferably on the double bond carbon in the group. $R_3$ is preferably an unsubstituted linear alkenyl group.

In formula (I), $R_3$ is preferably an alkenyl group having from 2 to 22 C atoms (e.g., vinyl, allyl, 3-butenyl, 2-butenyl, 2-methyl-1-propenyl, 4-octenyl, oleyl ($-(CH_2)_7-CH=CH-C_8H_{17}$), linoleyl ($-(CH_2)_7-CH=CHCH_2CH=CH-C_5H_{11}$), ricinoleyl ($-(CH_2)_7-CH=CHCH_2CH(OH)C_6H_{13}$), 10undecenyl, $-(CH_2)_{11}-CH=CH-C_8H_{17}$, $-(CH_2)_7-CBr=CH-CSH_{17}$, $-(CH_2)_7-CCl\odot CH-C_8H_{17}$. $R_3$ is more preferably an alkenyl group of the above-mentioned formula (II).

In formula (II), $R_{13}$ is preferably a hydrogen atom, an alkyl group having from 1 to 17 C atoms (e.g., methyl, ethyl, i-propyl, t-butyl, octyl, 2-hydroxyoctyl), or an alkenyl group having from 2 to 17 C atoms (e.g., 2-octenyl, 2,4-octadienyl, vinyl, allyl, 3-butenyl), preferably an alkyl group having from 5 to 12 C atoms or an alkenyl group having from 5 to 12 C atoms, more preferably an alkyl or alkenyl group having 8 C atoms, most preferably an octyl group. $R_{14}$ and $R_{15}$ each are independently a hydrogen atom, a chlorine atom or a bromine atom, preferably these are both hydrogen atoms or either one of these is a hydrogen atom, and more preferably these are both hydrogen atoms. k is an integer of from 3 to 11, preferably an integer of from 5 to 11, more preferably 7, 8 or 11, and most preferably 7.

Concretely, $R_3$ is preferably an oleyl group, a linoleyl group, a ricinoleyl group, a linolenyl group, a 10-undecenyl group,13 $(CH_2)_{11}-CH=CH-C_8H_{17}$, $-(CH_2)_7-CBr=CH-C_8H_{17}$, $-(CH_2)_7-CCl=CH-C_8H_{17}$, $-(CH_2)_7-CH=CBrC_8H_{17}$, $-(CH_2)_7-CH=CClC_8H_{17}$, more preferably an oleyl group, a linoleyl group, a 10-undecenyl group or $-(CH_2)_{11}-CH=CH-C_8H_{17}$, even more preferably an oleyl group or a linoleyl group, and most preferably an oleyl group ($-(CH_2)_7-CH=CH-C_8H_{17}$).

In formula (I), $R_4$ is a substituent, preferably an aliphatic group having from 1 to 30 C atoms (e.g., methyl, i-propyl, t-butyl), an aliphatic-oxy group having from 1 to 30 C atoms (e.g., methoxy, i-propoxy, benzyloxy, 2-ethylhexyloxy, hexadecyloxy, cyclohexyloxy ), an acylamino group having from 2 to 30 C atoms (e.g., acetylamino, benzylamino, pivaloylamino), a carbamoyl group having from 1 to 30 C atoms (e.g., N-methylcarbamoyl, N-phenylcarbamoyl, N,N-dibutylcarbamoyl, N-methyl-N-phenylcarbamoyl), an alkoxycarbonyl group having from 2 to 30 C atoms (e.g., methoxycarbonyl, hexytoxycarbonyl, octadecyloxycarbonyl), an alkylsulfonamido group having from 1 to 30 C atoms (e.g., methanesulfonamido, octanesulfonamido, hexadecanesulfonamido), an arylsulfonamido group having from 6 to 36 C atoms (e.g., benzenesulfonamido, p-chlorobenzenesulfonamido), a cyano group, a nitro group, or a halogen atom (e.g., chlorine, bromine), and more preferably an aliphatic group, an aliphatic-oxy group or a halogen atom.

In formula (I), m is an integer of from 0 to 3, preferably 0 or 1, more preferably 0.

In formula (I), X is a hydrogen atom or a group capable of being split off from the formula by the coupling reaction with an oxidation product of an aromatic primary amine developing agent. X is preferably a heterocyclic group bonded at the coupling-active position in the formula via its nitrogen atom, or an aryloxy group.

Where X is a heterocyclic group, it is preferably an optionally substituted, 5-membered to 7-membered, monocyclic or condensed heterocyclic group and includes, for example, succinimide, maleinimide, phthalimide, diglycolimide, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidin-2-one, oxazolidin-2-one, thiazolidin-2-one, benzimidazolin-2-one, benzoxazolin-2-one, benzothiazolin-2-one, 2-pyrrolin-5one, 2-imidazolin-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4-thiazolidine, 2-imino-1,3,4-thizaolidin-4-one, etc. These hetero rings may optionally be substituted. As examples of substituents for these hereto rings, mentioned are a halogen atom, a hydroxyl group, a nitro group, an cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamido group, a sulfonamido group, a carbamoyl group, a sulfamoyl group, an ureido group, an alkoxycarbonylamino group, and a sulfamoylamino group. Where X is an aryloxy group, it is preferably an aryloxy group having from 6 to 30 C atoms. Where X is a heterocyclic group, it may optionally be substituted by substituent(s) selected from those mentioned above. As the substituents for the aryloxy group of X, preferred are a halogen atom, a cyano group, a nitro group, a carboxyl group, a trifluoromethyl group, an alkoxycarbonyl group, a carbonamido group, a sulfonamido group, a carbamoyl group, a sulfamoyl group, an alkylsulfonyl group and an arylsulfonyl group.

In formula (I), X is preferably represented by any of the following formulae (III-1) to (III-4):

(III-1)

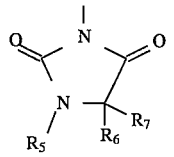

(III-2)

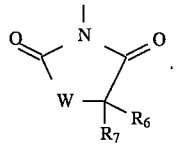

(III-3)

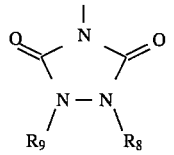

(III-4)

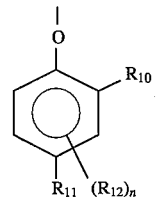

In these formulae, $R_6$ and $R_7$ each are independently and preferably a hydrogen atom, an alkyl group having from 1 to 20 C atoms (e.g., methyl, ethyl, i-propyl, t-butyl), an aryl group having from 6 to 26 C atoms (e.g., phenyl, 2-naphthyl, 4-methoxyphenyl, 3-chlorophenyl, 2-methylphenyl), an alkoxy group having from 1 to 20 C atoms (e.g., methoxy, ethoxy, i-propyloxy, t-butoxy), an aryloxy group having from 6 to 26 C atoms (e.g., phenoxy), or a hydroxyl group, more preferably a hydrogen atom, an alkyl group having from 1 to 10 C atoms, or an alkoxy group having from 1 to 10 C atoms, more preferably a hydrogen atom, a methyl group, a methoxy group or an ethoxy group.

$R_5$, $R_8$ and $R_9$ each are independently and preferably a hydrogen atom, an alkyl group having from 1 to 20 C atoms, an aryl group having from 1 to 20 C atoms (preferably such as those mentioned for $R_6$), an aralkyl group having from 7 to 20 C atoms (e.g., benzyl, phenethyl), or an acyl group having from 1 to 20 C atoms (e.g., acetyl, benzoyl), preferably a hydrogen atom, an alkyl group or an aralkyl group, more preferably a hydrogen atom, a methyl group, an ethyl group or a benzyl group.

In formula (III-2), W is an oxygen atom or a sulfur atom, preferably an oxygen atom.

In formula (III-4), at least one of $R_{10}$ and $R_{11}$ is any of a halogen atom, a cyano group, a nitro group, a trifluoromethyl group, a carboxyl group, an alkoxycarbonyl group having from 2 to 20 C atoms (e.g., methoxycarbonyl, i-propyloxycarbonyl), an acylamino group having from 1 to 20 C atoms (e.g., acetylamino, benzoylamino), a sulfonamido group having from 1 to 20 C atoms (e.g., methanesulfonamido, 4-methylphenylsulfonamido), a carbamoyl group having from 1 to 20 C atoms (e.g., N,N-diethylcarbamoyl, N-butylcarbamoyl), a sulfamoyl group having from 0 to 20 C atoms (e.g., N,N-dimethylsulfamoyl, N-phenylsulfamoyl), an alkylsulfonyl group having from 1 to 20 C atoms (e.g., methylsulfonyl, i-propylsulfonyl), an arylsulfonyl group having from 6 to 26 C atoms (e.g., phenylsulfonyl, 4-benzyloxyphenylsulfonyl, 4-hydroxyphenylsulfonyl), an acyl group having from 1 to 20 C atoms (e.g., acetyl, benzoyl) and a hydroxyl group, while the other is any of these substituents for $R_{10}$ and $R_{11}$ or is a hydrogen atom, an alkyl group or an alkoxy group. $R_{12}$ has the same meaning as $R_{10}$ or $R_{11}$, and n is an integer of from 0 to 2.

In formula (III-1), preferably, $R_5$ is a hydrogen atom, an alkyl group having from 1 to 4 C atoms or a benzyl group, and $R_6$ and $R_7$ each are a hydrogen atom, an alkyl group having from 1 to 4 C atoms or an alkoxy group having from 1 to 4 C atoms. More preferably, $R_5$, $R_6$ and $R_7$ each are a hydrogen atom or an alkyl group having from 1 to 4 C atoms; even more preferably, $R_5$ is a hydrogen atom while $R_6$ and $R_7$ are methyl groups, or $R_5$ is a methyl group while $R_6$ and $R_7$ are hydrogen atom; and most preferably, $R_5$ is a hydrogen atom while $R_6$ and $R_7$ are methyl groups.

In formula (III-2), preferably, W is an oxygen atom and $R_6$ and $R_7$ are methyl group.

In formula (I), X is preferably represented by formula (III-1) or (III-2), more preferably formula (III-1).

Specific examples of X in formula (I) are mentioned below, which, however, are not limitative.

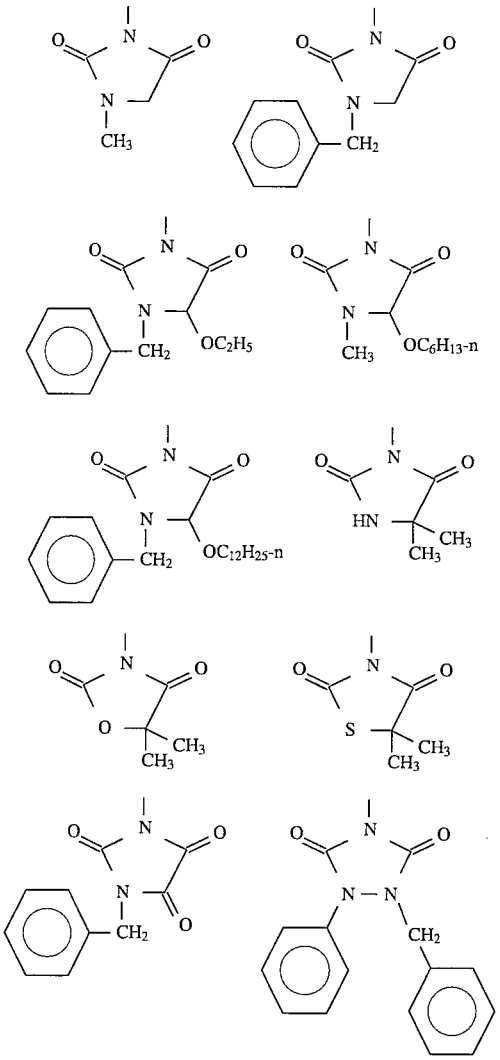

-continued

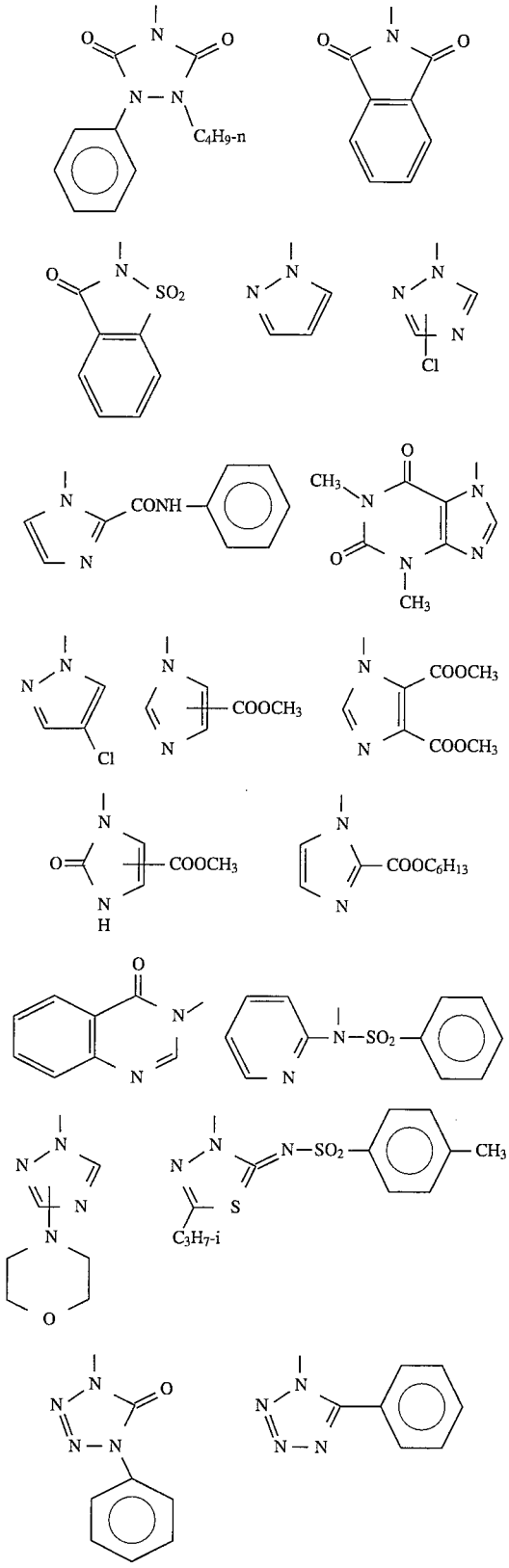

-continued

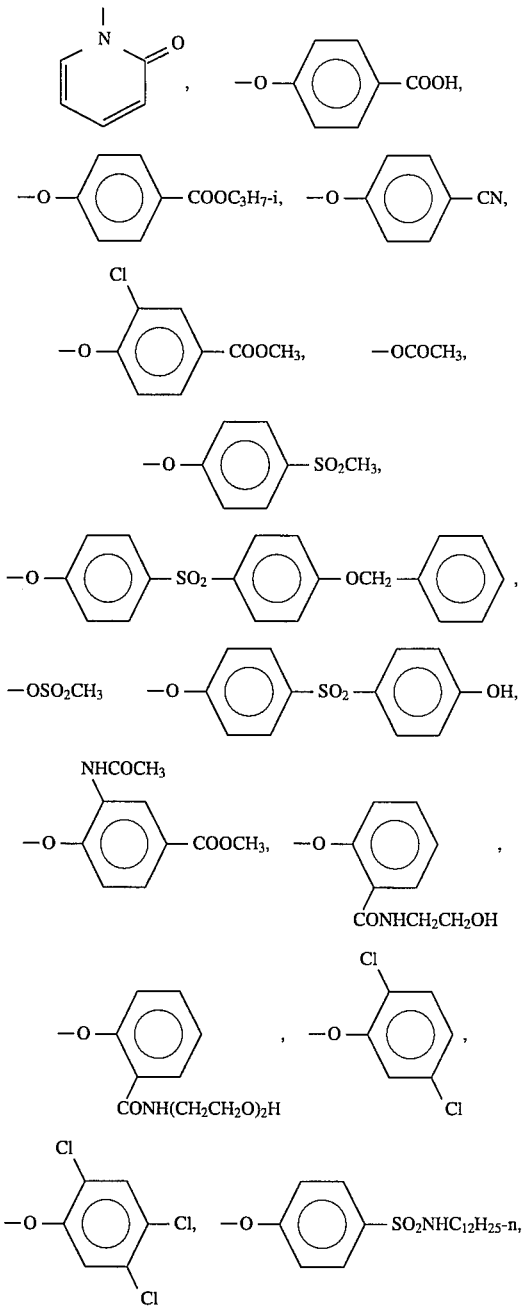

-continued

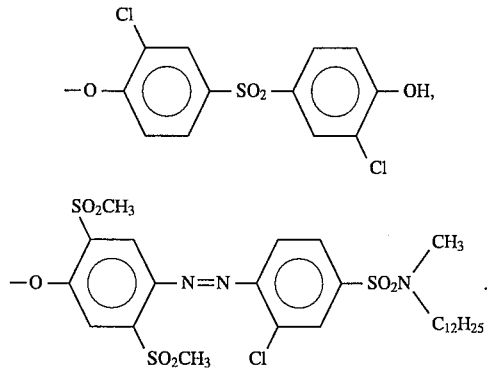

Yellow couplers of formula (I) may be bonded to each other at the substituents $R_1$, $R_2$, $R_4$ and/or X optionally via a divalent or higher poly-valent group to form dimers or polymers. To such dimers or polymers, the above-mentioned ranges of the number of the carbon atoms for the substituents do not always apply.

The preferred combinations of the substituents in the yellow couplers of formula (I) are such that $R_3$ is a group to be represented by formula (II) and X is a group to be represented by any of formulae (III-1) to (III-4). More preferably, in formula (I), $R_1$ is a t-butyl group, $R_2$ is a chlorine atom or a methoxy group, $R_3$ is an oleyl, linoleyl, linolenyl or ricinoleyl group, m is 0, and X is a group to be represented by formula (III-1). Even more preferably, in this combination, $R_2$ is a chlorine atom, $R_3$ is an oleyl or linoleyl group, and X is a group of formula (III-1) where $R_5$ is a hydrogen atom and $R_6$ and $R_7$ are methyl groups. Especially preferably, in this case, $R_3$ is an oleyl group ($-(CH_2)_7-CH=CHC_8H_{17}$).

Preferred examples of the yellow couplers of formula (I) of the present invention are mentioned below, which, however, are not limitative.

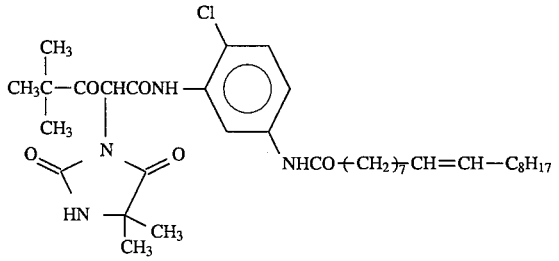

Y-1

-continued
Y-2
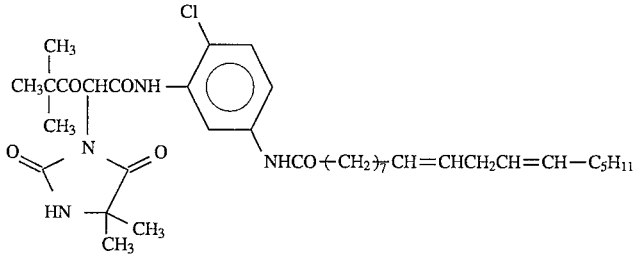
Y-3
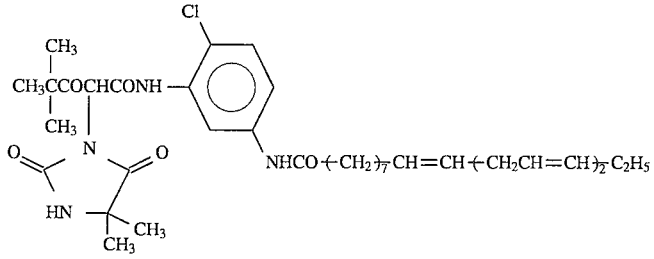
Y-4
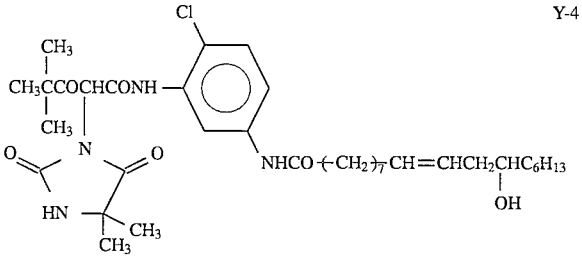
Y-5
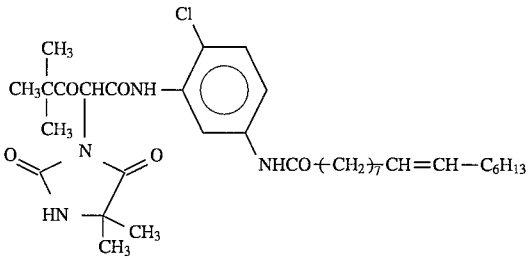
Y-6
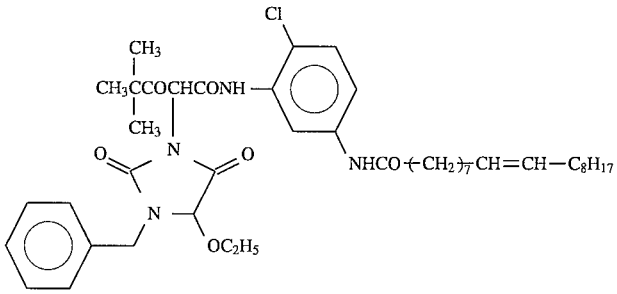
Y-7
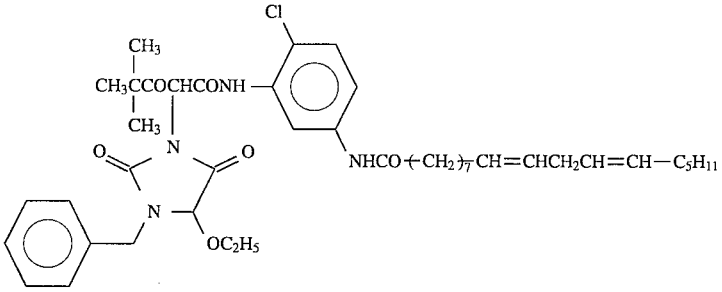
Y-8
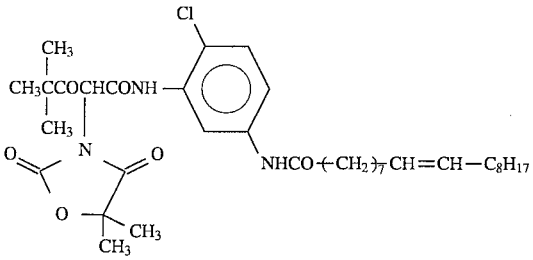
Y-9
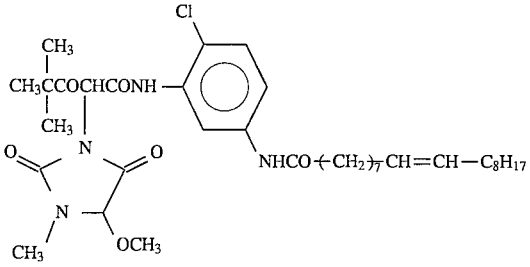

-continued
Y-10
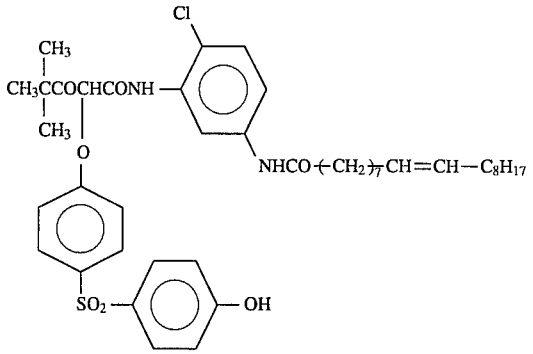
Y-11
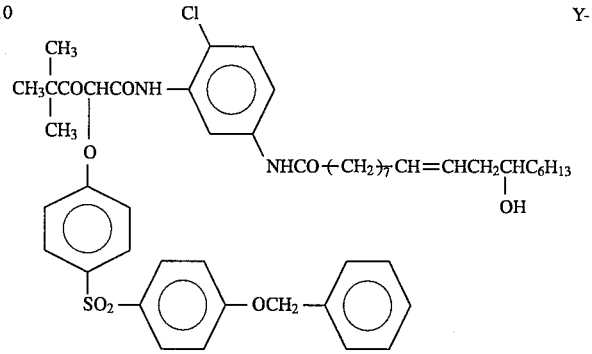
Y-12
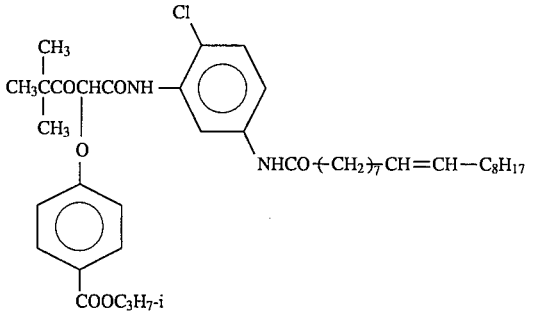
Y-13
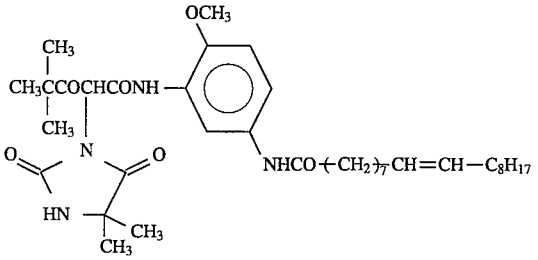
Y-14
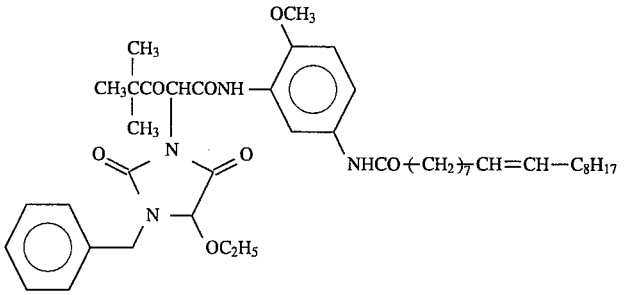
Y-15
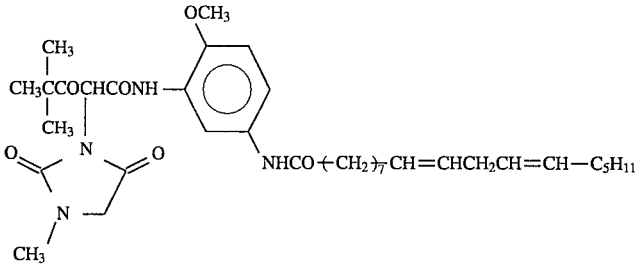
Y-16
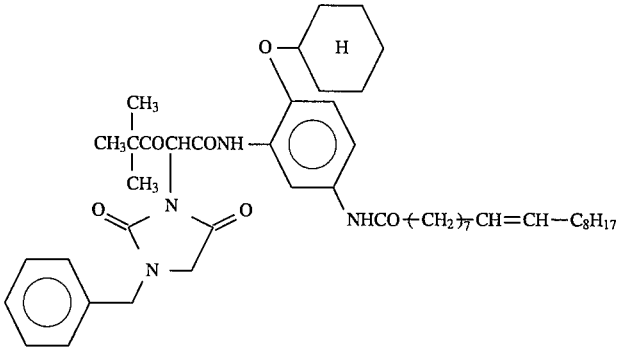

-continued
Y-17
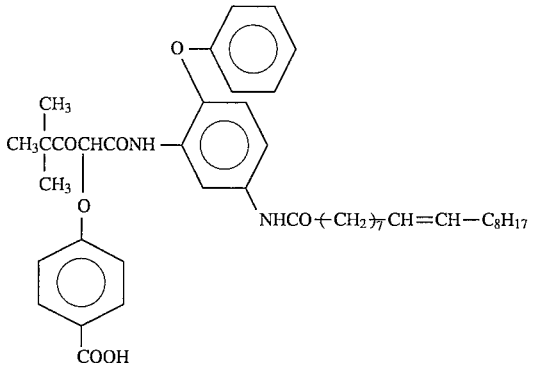
Y-18
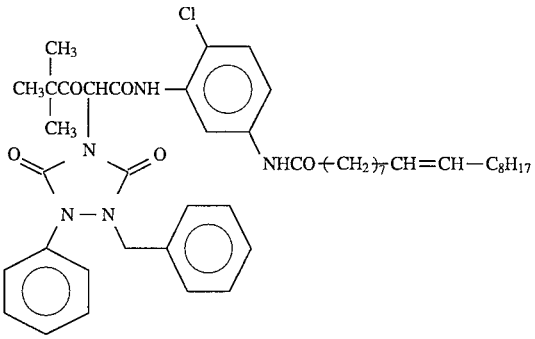
Y-19
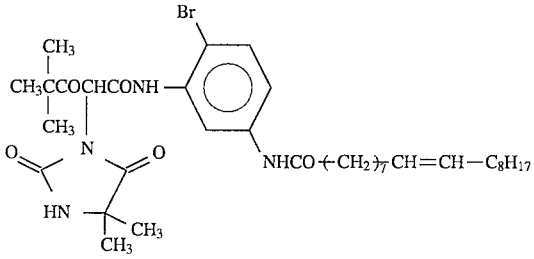
Y-20
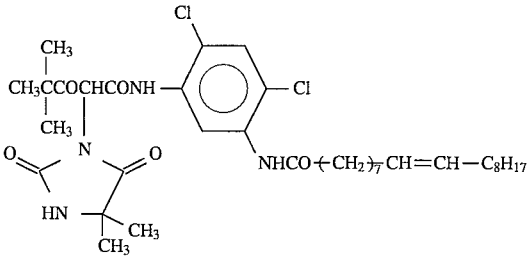
Y-21
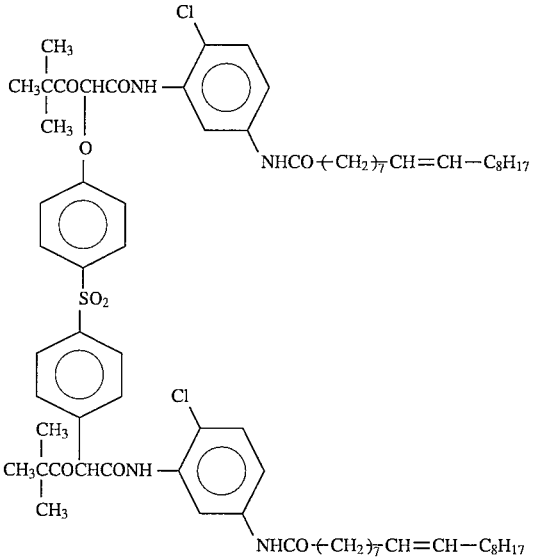
Y-22
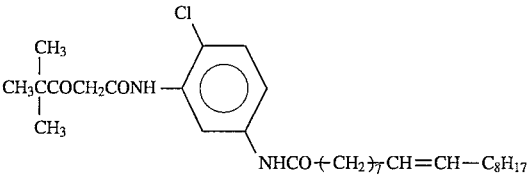
Y-23
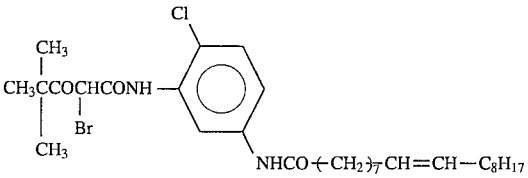
Y-24
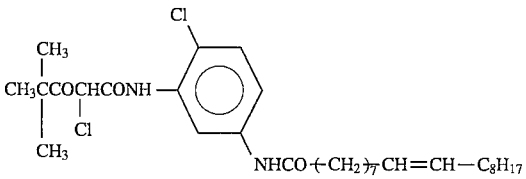

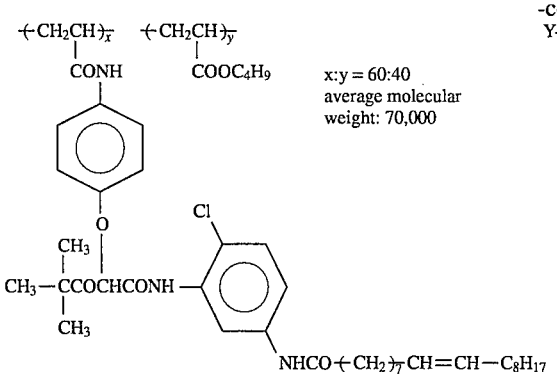
-continued
Y-25
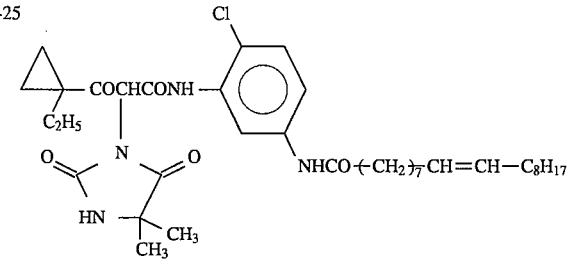
Y-26
Y-27
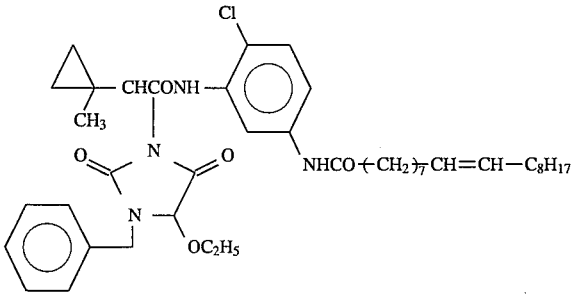
Y-28
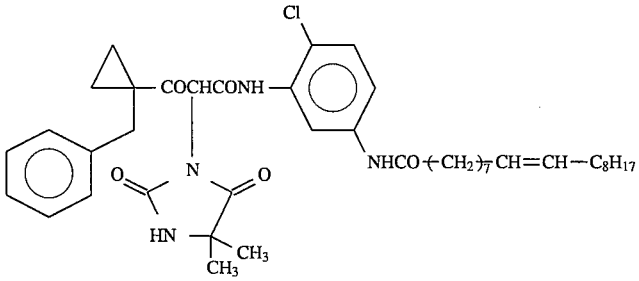
Y-29
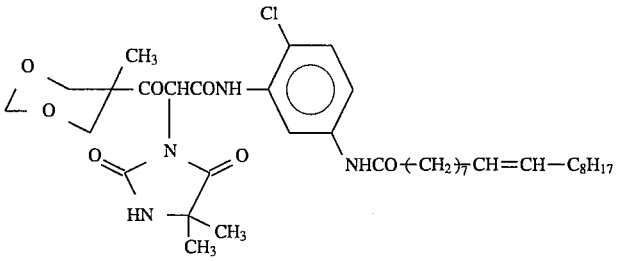
Y-30
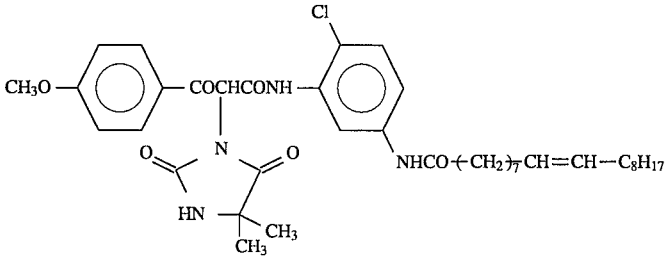

-continued
Y-31
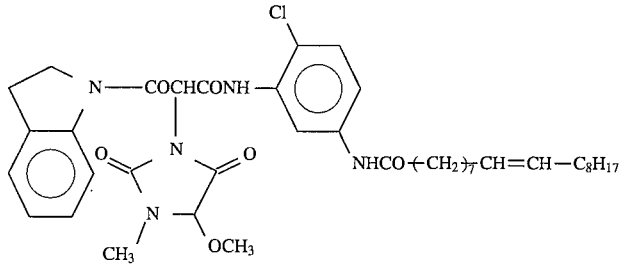
Y-32
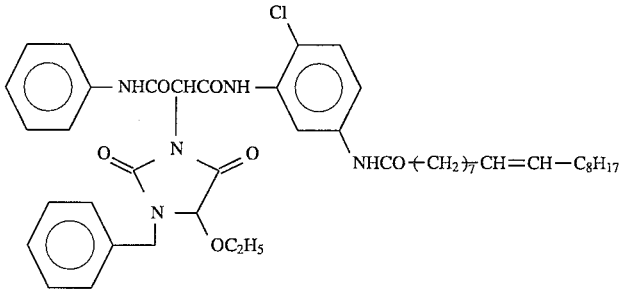
Y-33
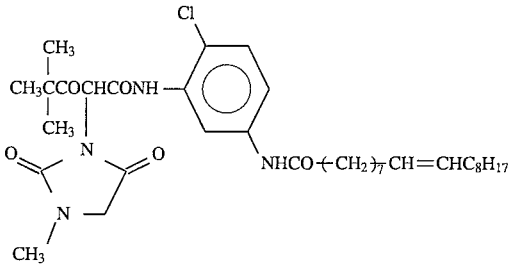
Y-34
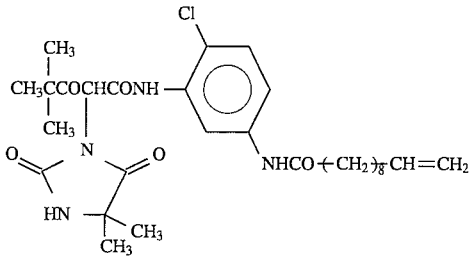
Y-35
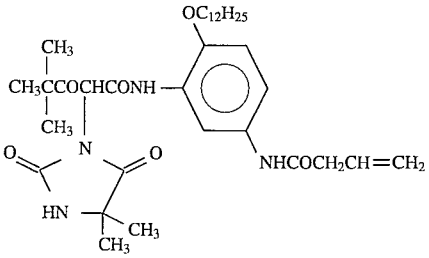
Y-36
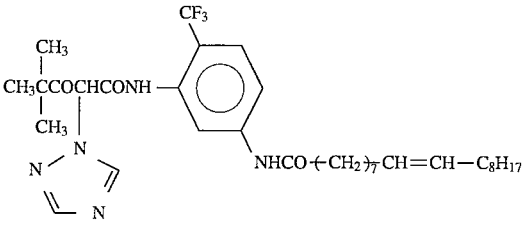
Y-37
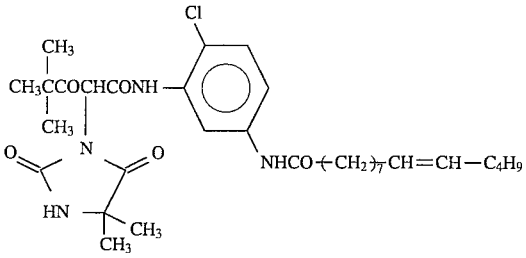
Y-38
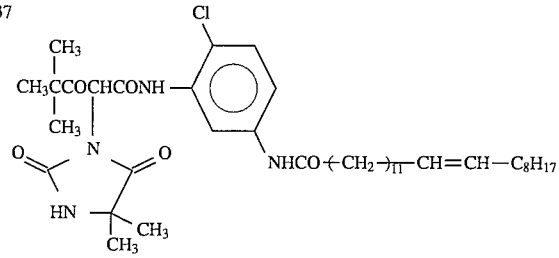
Y-39
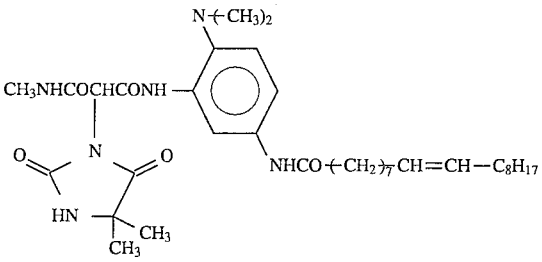
Y-40
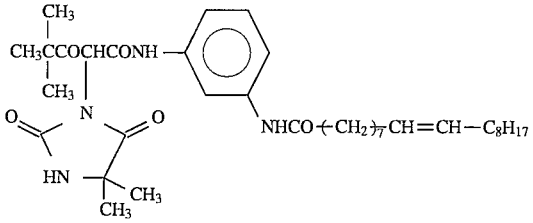

-continued
Y-41
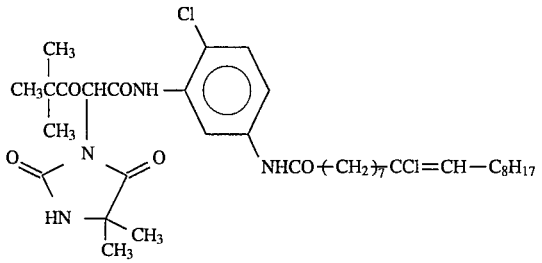
Y-42
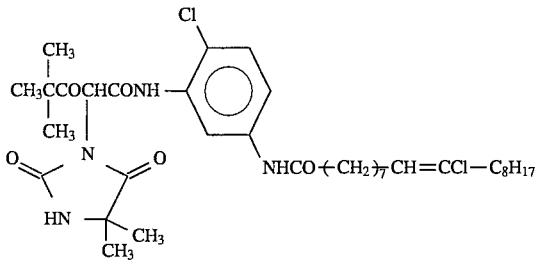
Y-43
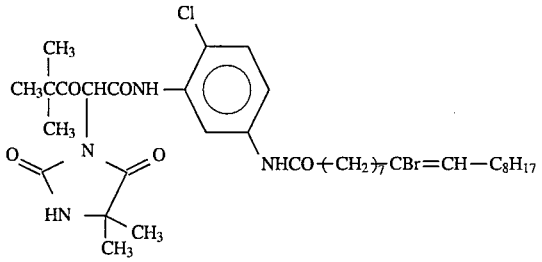
Y-44
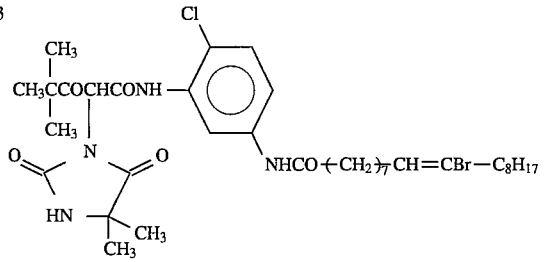
Y-45
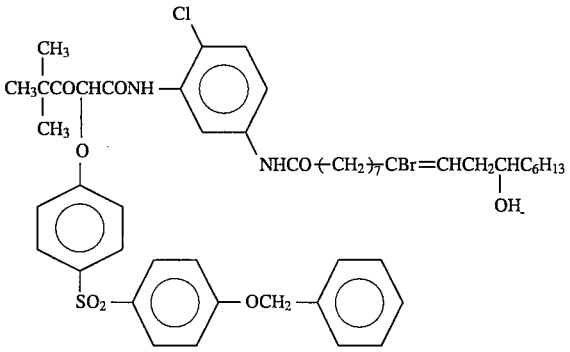
Y-46
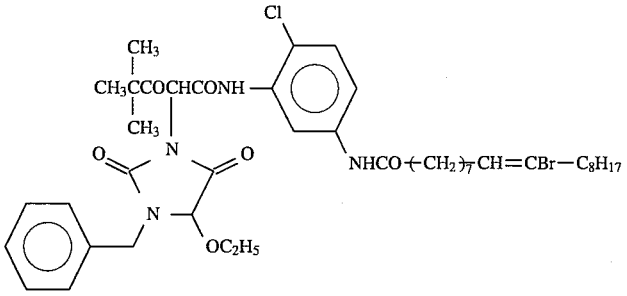
Y-47
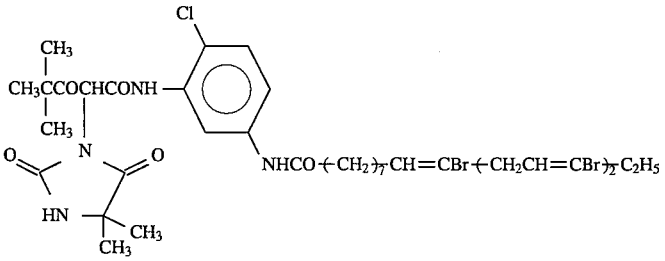
Y-48
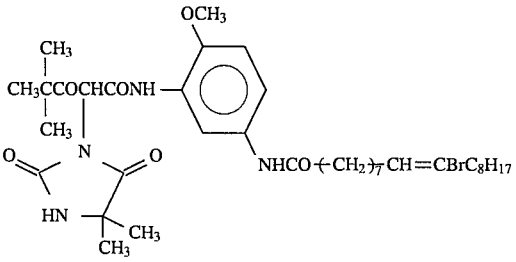
Y-49
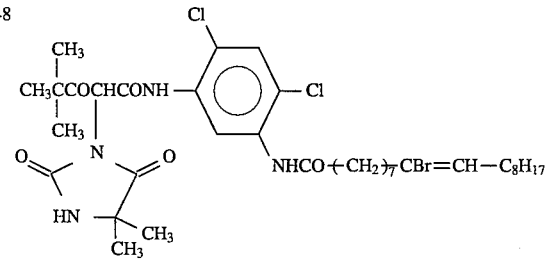

The yellow couplers of formula (I) can be produced by reacting an aniline compound of formula (I) where—NH-$COR_3$ is —$NH_2$, which is producible by known methods, with an acid chloride of $R_3COCl$ in a solvent of acetonitrile, dimethylformamide, ethyl acetate or the like in the presence of a deacidifying agent such as triethylamine, pyridine, potassium carbonate or the like. The acid chloride of $R_3COCl$ can be produced by reacting an easily available carboxylic acid of $R_3COOH$ with thionyl chloride, phosphorus trichloride, oxalyl chloride or the like.

Yellow couplers of Y-41, 42, 43 and 44 where chlorine or bromine atom is substituted on the double bond carbon atom are produced, in general, by reacting the corresponding intermediate having an alkenyl group with sulfuryl chloride, bromine or the like to thereby adding $Cl_2$ or $Br_2$ thereto, followed by treating the resulting product with a base to thereby remove HCl or HBr therefrom.

Production examples of demonstrating the production of some typical yellow couplers of the present invention are mentioned below, which, however, are not limitative.

(1) Production of Yellow Coupler Y-1:

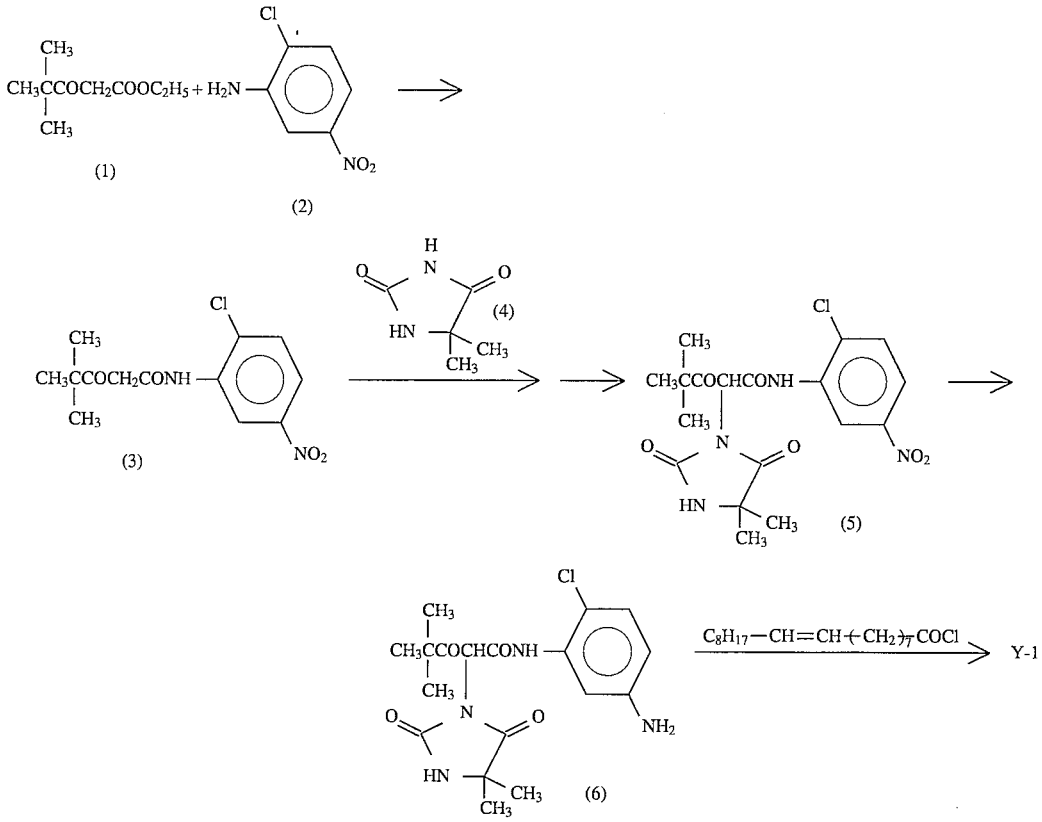

180.8 g (1.05 mol) of β-ketoester compound (1) were reacted with 120.8 g (0.7 mol) of aniline compound (2) at an internal temperature of 155° C. for 6 hours, while removing the ethanol generated at normal pressure. The non-reacted β-ketoester compound (1) was removed by distillation under a reduced pressure, then the reaction mixture was cooled, and 300 ml of acetonitrile were added thereto to make the crystals of compound (3) precipitated. The crystals of compound (3) were taken out by filtration and washed with acetonitrile. The yield of compound (3) was 159.2 g (76.1%).

159.2 g (0.533 mol) of compound (3) were dissolved in 500 ml of methylene chloride with stirring, and 87.9 g (0.55 mol) of bromine were dropwise added thereto over a period of 30 minutes and further stirred for 30 minutes. The reaction mixture was washed three times with water of 300 ml added thereto, then dried and concentrated, and this was added to a solution comprising 128.1 g (1 mol) of hydantoin compound (4), 182.7 g (1.2 mol) of DBU (1,8-diazabicyclo [5,4,0]undecene) and 200 ml of dimethylformamide. After stirred for 2 hours at room temperature, this was neutralized with a dilute hydrochloric acid added thereto and then subjected to liquid-liquid separation with ethyl acetate and a saturated brine added thereto. The thus-separated organic phase was washed two times with a saturated brine. This was dried with magnesium sulfate and then concentrated to obtain crystals of nitro compound (5). The yield of compound (5) was 200.4 g (88.5 %).

80 g of reduced iron and 4 g of ammonium chloride were dispersed in 30 ml of water and refluxed, and 4 ml of acetic acid and 300 ml of isopropyl alcohol were added thereto in this order and then refluxed. A dimethylacetamide solution of 88.2 g (0.208 mol) of nitro compound (5) was dropwise added thereto over a period of 30 minutes and further refluxed for 30 minutes. This was filtered through Celite, while hot, and the resulting filtrate was concentrated. This was subjected to liquid-liquid separation with ethyl acetate and a saturated brine added thereto. The thus-separated organic phase was washed two times with water, dried with magnesium sulfate and then concentrated to obtain an oily product of aniline compound (6). The yield of aniline compound (6) was 79.0 g (96.3 %).

79.0 g (0.2 mol) of aniline compound (6) and 19.0 g (0.24 mol) of pyridine were dissolved in 100 ml of acetonitrile and stirred, and 60.2 g (0.2 mol) of oleic acid chloride were dropwise added thereto over a period of 30 minutes and then further stirred for 1 hour. After concentrated, the reaction mixture was subjected to liquid-liquid separation with ethyl acetate and a dilute hydrochloric acid added thereto and then washed two times with water. After dried with magnesium sulfate, this was purified by silica gel column chromatography (with hexane/ethyl acetate =3/2). After crystallized from acetonitrile, 106.5 g (80.8 %) of white crystals of Y-1 were obtained.

The physical properties of the product Y-1 are as follows: m.p. 133° C.;

$^1$HNMR spectrum (300 MHz, $CDCl_3$, δ: ppm): 0.88 (3H, t, $CH_3CH_2$)1.28 (9H, S, $(CH_3)_3C$—, 18H, m, —$CH_2$—), 1.43 (3H, S, $(CH_3)_2C$<, 1.50 (3H, S, $(CH_3)_2C$<), 1.6–1.8 (4H, m, —$CH_2$—), 1.9–2.1 (4H, m, —$CH_2$—CH=CH—), 2.31 (2H, t, —$CH_2$CONH), 5.25–5.45 (2H, m, —CH⊚CH—), 5.64 (1H, S, CH), 6.30 (1H, S, CONH), 7.26 (1H, d, aromatic), 7.38 (1H, S, CONH), 7.75 (1H, d of d, aromatic), 7.96 (1H, d, aromatic), 9.30 (1H, S, CONH)

MS spectrum: 658 ($M^+$), 623, 547, 497, 452, 406

(2) Production of Yellow Couplers Y-41 and Y-42:

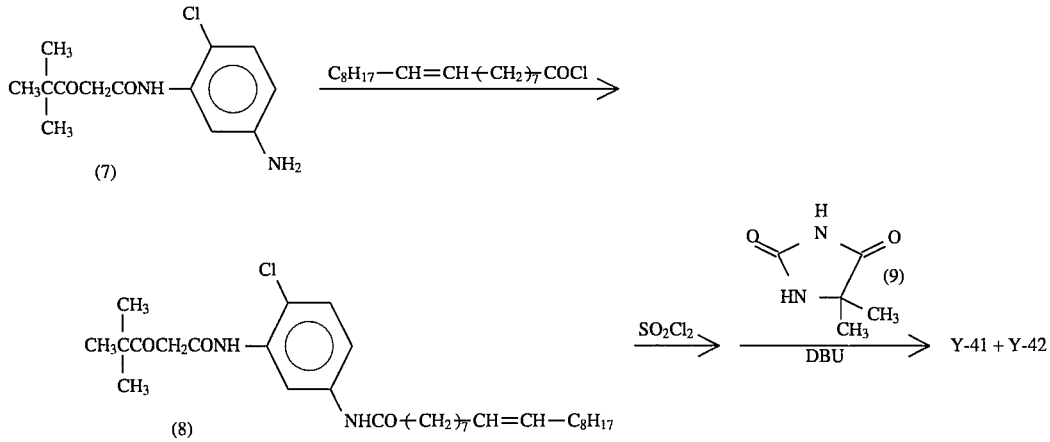

91.4 g (0.34 mol) of aniline compound (7) and 30.8 g (0.39 mol) of pyridine were dissolved in 200 ml of acetonitrile and stirred, and 106.7 g (0.355 mol) of oleic acid chloride were dropwise added thereto over a period of minutes and further stirred for 1 hour. 200 ml of water were added thereto and stirred, and crystals of compound (8) thus precipitated were taken out by filtration and washed with water. The yield of compound (8) was 176.5 g (97.4 %).

53.3 g (0.1 mol) of compound (8) were dissolved in 0 ml of tetrahydrofuran and stirred, and 27.0 g (0.2 mol) of sulfuryl chloride were dropwise added thereto over a period of 30 minutes and further stirred for 30 minutes. Next, the reaction mixture was concentrated under a reduced pressure with an aspirator.

19.2 g (0.15 mol) of hydantoin compound (9) and 45.7 g (0.3 mol) of DBU were dissolved in 100 ml of dimethylformamide and stirred, and the reaction mixture obtained above was added thereto and stirred at 80° C. for 2 hours. After cooled, this was subjected to liquid-liquid separation with ethyl acetate and HCl aqueous solution added thereto in a neutral condition, and the thus-separated organic phase was washed two times with water, then dried with magnesium sulfate and concentrated. This was purified by silica gel column chromatography (with ethyl acetate/hexane=2/3) to obtain an amorphous mixture of Y-41 and Y-42. The yield of the product was 56.9 g (82.0 %). The purity of the product was confirmed by HPLC.

The physical properties of the product are as follows:

NMR spectrum (300 MHz, $CDCl_3$, δ: ppm): 0.88 (3H, t, $CH_3CH_2$—), 1.28 (9H, S, $(CH_3)_3C$—, 18H, m, —$CH_2$—), 1.43 (3H, S, $(CH_3)_2C$<, 1.50 (3H, S, $(CH_3)_2C$<), 1.5–2.0 (6H, m, —$CH_2$—), 2.30 (2H, t, —$CH_2$CONH), 3.3–4.1 (2H, m, $CH_2$CCl=CH—), 5.3–5.4 (1H, m, —CCl=CH—), 5.65 (1H, S, CH), 6.73 (1H, S, CONH), 7.20 (1H, d, aromatic), 7.68 (1H, d, aromatic), 7.88 (1H, S, CONH), 8.00 (1H, d, aromatic), 9.30 (1H, S, CONH)

MS spectrum: 693($M^+$), 658, 604, 568, 550,547

Of the carboxylic acids of $R_3COOH$ to be used for producing the yellow couplers of formula (I), the compound where $R_3$ is $CSH_{17}$—CH=CH—$(CH_2)_7$—is referred to as oleic acid, the compound where $R_3$ is $C_5H_{11}CH$=$CHCH_2CH$=CH—$(CH_2)_7$—is as linoleic acid, the compound where $R_3$ is $C_2H_5$—(CH=$CHCH_2)_2$—CH=CH—$(CH_2)_7$—is as linolenic acid and the compound where $R_3$ is $C_6H_{13}CH(OH)CH_2CH$=CH—$(CH_2)_7$—is as recinoleic acid. Plenty of these compounds are obtained from natural oils and fats such as animal and vegetable oils, etc. Therefore, these compounds are very low-priced.

Accordingly, the yellow couplers of formula (I) of the present invention are characterized in that they are produced at extremely low costs.

Oleic acid which is commercially sold often contains minor other unsaturated and saturated fatty acids having a carbon chain length different from that of the acid.

For example, oleic acid having a purity of 75%, which is produced by Nippon Oils & Fats Co., contains unsaturated fatty acids of linoleic acid (7%), $C_{16}$ unsaturated carboxylic acids (7%) and $C_{14}$ unsaturated carboxylic acids (1%), and additionally myristic acid (3 palmitic acid (6%) and stearic acid (1%).

Oleic acid having a purity of 91%, which is produced by the same company, contains linoleic acid (4%), $C_{16}$ unsaturated carboxylic acids (2 %), stearic acid (2%) and palmitic acid (1%).

Where oleic acid or oleic acid chloride is used to produce the yellow couplers of the present invention, oleic acid containing impurities such as those mentioned above can be used.

The silver halide color photographic material of the present invention contains one or more of the yellow couplers of formula (I) optionally along with other known yellow coupler(s).

The yellow coupler of formula (I) may be in any hydrophilic colloid layer constituting the photographic material but is preferably in the blue-sensitive silver halide emulsion layer of the material.

The amount of the yellow coupler of formula (I) to be in the silver halide color photographic material (hereinafter often referred to simply as "photographic material") of the present invention is preferably from 0.01 to 10 mmol/$m^2$, more preferably from 0.05 to 5 mmol/$m^2$, most preferably from 0.1 to 2 mmol/$m^2$. The photographic material may contain two or more yellow couplers of formula (I) optionally along with coupler(s) other than the couplers of formula(I).

The objects of the present invention have been attained more significantly by a photographic material having on the support at least one layer that contains the yellow coupler(s) of formula (I) along with a compound of the following general formula (IV):

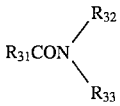

(IV)

wherein $R_{31}$, $R_{32}$ and $R_{33}$ each independently represent a hydrogen atom, an aliphatic group or an aryl group, provided that the sum of the carbon atoms constituting the groups $R_{31}$, $R_{32}$ and $R_{33}$ is from 9 to 80.

Compounds of formula (IV) are described in detail hereinunder.

In formula (IV), preferably, $R_{31}$, $R_{32}$ and $R_{33}$ each independently represent a hydrogen atom, an aliphatic group having from 1 to 40 C atoms (e.g., methyl, ethyl, t-butyl, i-propyl, benzyl, 1-(2,4-di-t-amylphenoxy)propyl, heptyl, undecyl, 1-ethylpentyl, cyclohexyl, 9-decenyl, 1-hexylnonyl, 2-ethylhexyl, dodecyl, 1-hexyldecyl, octyl, 4,6,6-trimethyl-1-(1,3,3-trimethylbutyl)heptyl), or an aryl group having from 6 to 40 C atoms (e.g., phenyl, 2-napthyl, 2-chlorophenyl, 3-methylphenyl, 4octyloxyphenyl). The sum of the carbon atoms constituting the groups $R_{31}$, $R_{32}$ and $R_{33}$ is from 9 to 80, preferably from 13 to 60, more preferably from 15 to 50. $R_{31}$ and $R_{32}$, and $R_{32}$ and $R_{33}$ may be optionally bonded to each other to form a ring (e.g., piperidine ring, piperazine ring, morpholine ring, pyrrolidine ring, triazine ring).

The compounds of formula (IV) may be bonded to each other at any position of $R_{31}$, $R_{32}$ and $R_{33}$ to form oligomers or polymers. To such oligomers or polymers, the definition of the number of the carbon atoms constituting the groups as referred to hereinabove does not always apply.

The compounds of formula (IV) are preferably those of the following formula (V)

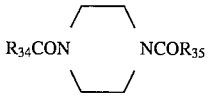

(V)

wherein $R_{34}$ and $R_{35}$ each have the same meaning as $R_{31}$ in formula (IV), and the sum of the carbon atoms constituting $R_{34}$ and $R_{35}$ is from 12 to 75.

In formula (V), $R_{34}$ and $R_{35}$ are preferably the same, more preferably alkyl groups having from 8 to 26 C atoms, even more preferably branched alkyl groups of the following formula (VI)

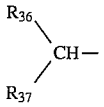

(VI)

In formula (VI), $R_{36}$ represents a linear or branched alkyl group having from 4 to 13 C atoms; and $R_{37}$ represents a linear or branched alkyl group having from 2 to 11 C atoms. Preferably, $R_{36}$ is a branched alkyl group having from 7 to 13 C atoms, and $R_{37}$ is a branched alkyl group having from 5 to 11 C atoms; and more preferably $R_{36}$ is a branched alkyl group having from 9 to 10 C atoms, and $R_{37}$ is a branched alkyl group having from 7 to 8 C atoms. Most preferably, the number of carbon atoms constituting $R_{36}$ is less than that of carbon atoms constituting $R_{37}$ by 2.

Specific examples of the compounds of formula (IV) are mentioned below, which, however, are not limitative. Regarding the expression of $C_8H_{17}$-i or the like, its branching mode may include a single component and a mixture of two or more plural components. For instance, the expression of $C_8H_{17}$-i may include a mixture of 2-ethylhexyl, 2-ethyl-4-methylpentyl, 2,2,4-trimethylpentyl, etc.

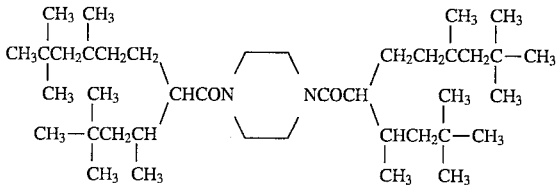

S-1

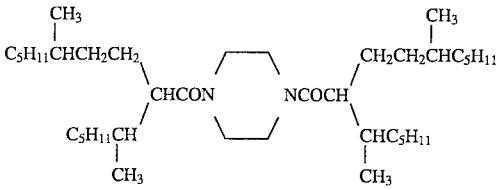

S-2

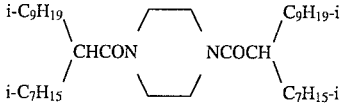

S-3

-continued
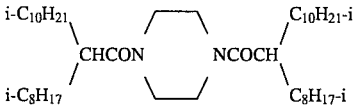
S-4
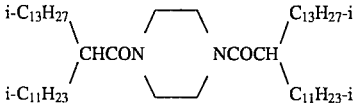
S-5
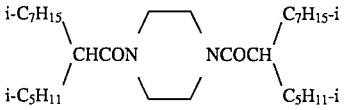
S-6
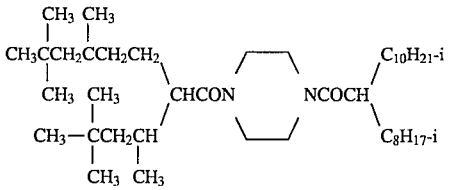
S-7
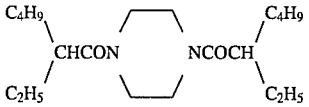
S-8
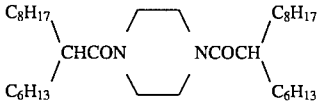
S-9
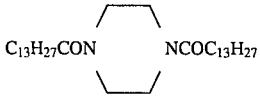
S-10
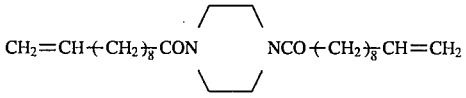
S-11
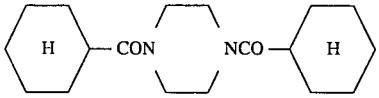
S-12
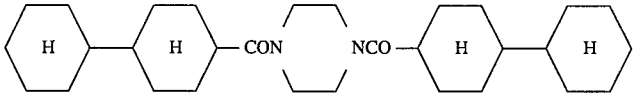
S-13
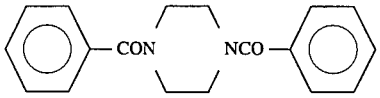
S-14
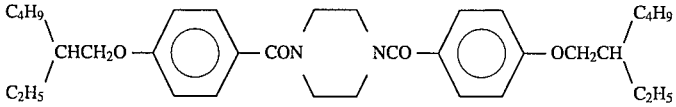
S-15
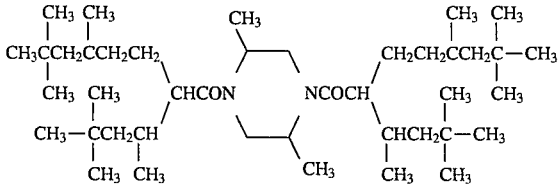
S-16

-continued
S-17
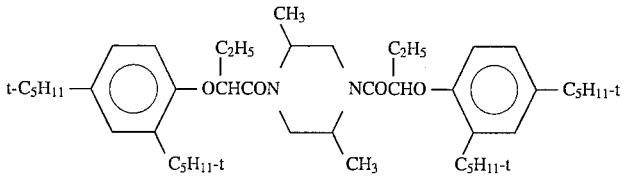
S-18
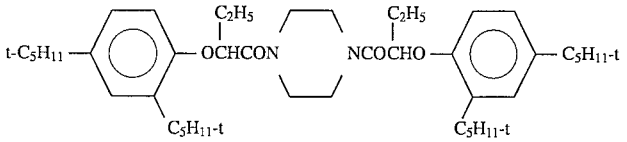
S-19
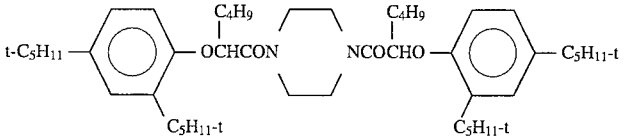
S-20
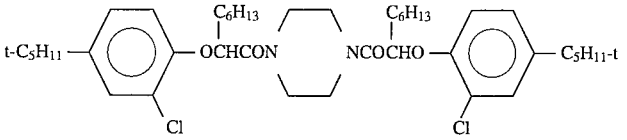
S-21
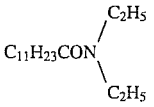
S-22
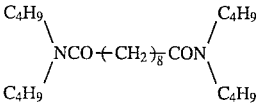
S-23
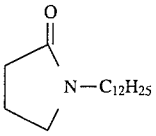
S-24
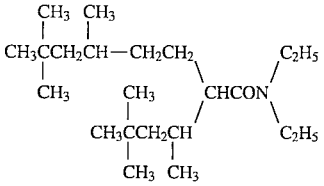
S-25
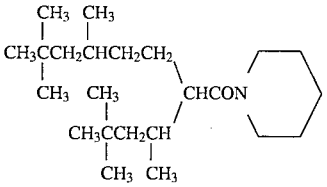
S-26
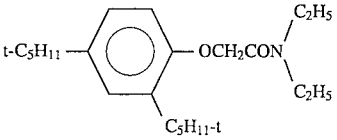
S-27
$\left(CH_2CH\right)_n$ (CONHC$_4$H$_9$(t)) average molecular weight: 60,000
S-28
$C_8H_{17}CH{=}CH(CH_2)_7CONH_2$ -continued $C_8H_{17}CH{=}CH{+}CH_2{\rangle}_7CONH{+}CH_2{\rangle}_8CH{=}CHC_8H_{17}$ S-29

$i\text{-}C_{17}H_{35}CONHCH{=}CH_2NHCOC_{17}H_{35}\text{-}i$ S-30

S-31

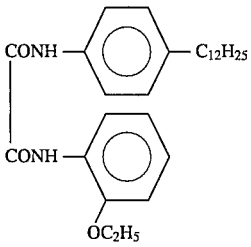

S-32

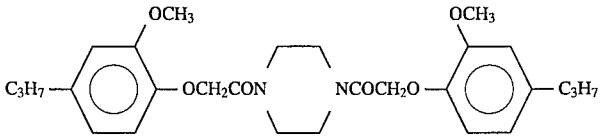

S-33

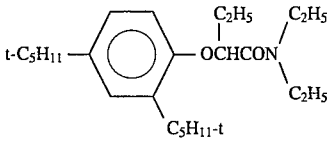

S-34

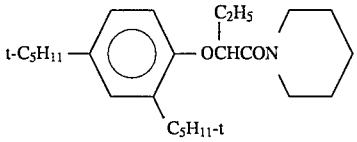

Examples of demonstrating the production of some typical compounds of formula (IV) are mentioned below.

In general, the compounds of formula (IV) are easily produced by reacting a carboxylic acid with thionyl chloride, phosphorus trichloride, oxalyl chloride or the like to give a carboxylic acid chloride followed by reacting the resulting chloride with an amine in the presence of a deacidifying agent such as triethylamine, sodium carbonate, potassium carbonate or the like.

Production of S-1:

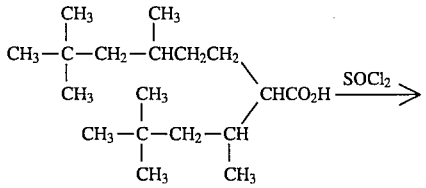

Nissan Chemical Co.
"FINE OXOCOL"
Isostearic acid

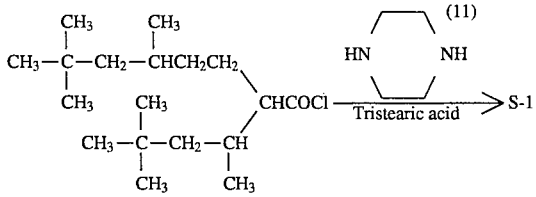

(10)

1.0 g of DMF was added to 568.9 g (2 mol) of isostearic acid produced by Nissan Chemical Co., and 261.8 g (2.2 mol) of thionyl chloride were dropwise added thereto over a period of 30 minutes with stirring. After stirred for 30 minutes at room temperature and then for further 30 minutes at 40° C., this was concentrated under a reduced pressure, using an aspirator, to obtain 605.8 g (yield: 100%) of carboxylic acid chloride (10). 86.1 g (1 mol) of anhydrous piperazine (11) and 242.8 g (2.4 mol) of triethylamine were dissolved in 1250 ml of ethyl acetate and stirred with cooling with ice in water. To this were dropwise added 605.8 g of the carboxylic acid chloride obtained above, over a period of 1 hour. This was further stirred for 30 minutes, then heated and further stirred for 1 hour at 50° C.

500 ml of water were added thereto to make the organic phase extracted. The organic phase was washed three times with water, then dried with magnesium sulfate and concentrated to obtain 607.0 g (yield: 98.1%) of a pale yellow oil of S-1.

The structure of S-1 thus obtained was confirmed by NMR, IR and MS spectra and gas chromatography.

NMR spectrum (300 MHz, $CDCl_3$, δ: ppm): 1.0–1.2 (48H, S or d, $CH_3$), 1.2–2.0 (20H, m, —$CH_2$—or =CH—), 2.4–2.7 (2H, m, —CHCO<), 3.6–4.0 (8H, m, >$NCH_2CH_2N$<)

MS spectrum:

618($M^+$), 603, 551, 463, 353

The photographic material of the present invention may contain one or more compounds of formula (IV) optionally along with any other known anti-fading agent.

The compound of formula (IV) functions essentially as a high boiling point organic solvent, and this can be combined with any known high boiling point organic solvent. If desired, the compound of formula (IV) may be used as a stabilizer or the like additive. The "high boiling point" as referred to herein means a boiling point of 175° C. or higher.

The amount of the compound of formula (IV) to be in the photographic material of the present invention may be varied in accordance with the intended object of the invention and is not specifically defined. The amount of the compound is preferably from 0.0002 g to 20 g, more preferably from 0.001 g to 5 g, per 1 $m^2$ of the photographic material, and is preferably from 0.1/1 to 8/1, more preferably from 0.1/1 to 4.0/1, even more preferably from 0.2/1 to 1.0/1, in terms of the ratio by weight to the coupler of formula (I) to be in the photographic material.

Where the compound of formula (IV) is combined with a known high boiling point organic solvent, the amount of the former is preferably from 10% by weight to 100% by weight, more preferably from 20% by weight to 70 % by weight of the total amount of the high boiling point organic solvents.

Examples of high boiling point solvents which can be used along with the compounds of formula (IV) are described in U.S. Pat. No. 2,322,027. As specific examples of high boiling point organic solvents having a boiling point of 175° C. or higher at normal pressure, which can be combined with the compounds of formula (IV), mentioned are phthalates (e.g., dibutyl phthalate, dicyclohexyl phthalate, di-2-ethylhexyl phthalate, decyl phthalate, bis(2,4-di-tert-amylphenyl) phthalate, bis(2,4-di-tert-amylphenyl) isophthalate, bis(1,1-diethylpropyl) phthalate), phosphates and phosphonates (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl-p-hydroxy benzoate), sulfonamides (e.g., N-butylbenzenesulfonamide), alcohols and phenols (e.g., isostearyl alcohol, 2,4-di-tert-amylphenol), aliphatic carboxylates (e.g., bis(2ethylhexyl) sebacate, dioctyl adipate, glycerol tributyrate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene), chlorinated paraffins, etc. As auxiliary solvents, usable are organic solvents having a boiling point of 30° C. or higher, preferably 50° C. to about 160° C. As specific examples of such solvents, mentioned are ethyl acetate, butyl acetate, ethyl propionate, methyl ethyl ketone, cyclohexanone, 2-ethoxyethyl acetate, dimethylformamide.

In general, the photographic material of the present invention has at least one blue-sensitive silver halide emulsion layer, at least one green-sensitive silver halide emulsion layer and at least one red-sensitive silver halide emulsion layer in this order on the support, but the order of the emulsion layers may be different from this. These photosensitive emulsion layers each contain a silver halide emulsion sensitive to the corresponding wavelength range and coupler(s) of forming a dye which is complementary to the light to which each emulsion is sensitive, and the photographic material comprising such emulsion layers is subjected to color reproduction by subtractive color photography. The combination of the photosensitive emulsion layer and the color of the dye to be formed from the coupler in the layer is not limited to only the above-mentioned ones.

Regarding the silver halide emulsions and other materials (additives, etc.) and the constitution of photographic constitutive layers (order of layers, etc.) constituting the photographic material of the present invention, as well as the methods for processing the material and the additives to be used for processing the material, those described in JP-A-62-215272 and JP-A-2-33144 and European Patent EP 0,355,660A2 are preferably employed in the present invention.

In addition, the constitutions of silver halide color photographic materials and the methods for processing them, which are described in JP-A-5-34889, JP-A-4-359249, JP-A-4-313753, JP-A-4-270344, JP-A-5-66527, JP-A-4-34548, JP-A-4-145433, JP-A-2-854, JP-A-1 -158431, JP-A-2-90145, JP-A-3-194539, JP-A-2-93641 and European Patent EP 0,520,457A2 are also preferably employed in the present invention.

The silver halides constituting the photographic material of the present invention include silver chloride, silver bromide, silver chlorobromide, silver iodochlorobromide, silver iodobromide, etc. To rapidly process the photographic material, it is preferred that the material comprises a silver chlorobromide chloride emulsion substantially not containing silver iodide and having a silver chloride content of from 90 mol% to 100 mol% more preferably from 95 mol% to 100 mol% even more preferably from 98 mol% to 100 mol% or comprises a pure silver chloride emulsion.

In order to improve the sharpness of the image to be formed, it is desirable to add dyes which are capable of being decolored by processing (especially oxonole dyes), such as those described on pages 27 to 76 of European Patent EP 0,337,490A2, to the hydrophilic colloid layers constituting the photographic material of the present invention in such a way that the optical reflection density of the material at 680 nm may be 0.70 or more. Alternately, adding titanium oxide, of which the surface has been treated with dihydric to tetrahydric alcohols (e.g., trimethylolethane) or the like, to the waterproof resin layer constituting the support of the material at 12% by weight or more, preferably at, can improve.

It is desirable that the photographic material of the present invention contains color image preservation improving compounds such as those described in European Patent EP 0,277,589A2, along with couplers. It is especially desirable that such compounds are combined with pyrazoloazole-type magenta couplers.

Specifically, it is desirable to add to the photographic material one or more of compounds (F) which are chemically bonded to an aromatic amine developing agent remaining after color development to give a chemically inactive and substantially colorless compound and/or compounds (G) which are chemically bonded to an oxidation product of an aromatic amine developing agent remaining after color development to give a chemically inactive and substantially colorless compound, by which, for example, the reaction of the remaining color developing agent and its oxidation product with the remaining couplers to give unfavorable color dyes which cause stains and other harmful side effects can be prevented during the storage of the processed photographic material.

It is also desirable to add an anti-microbial agent, such as that described in JP-A-63-271247, to the photographic material of the present invention, by which the propagation of various fungi and bacteria in the hydrophilic colloid layers constituting the material to worsen the image formed can be prevented.

The support of the photographic material for display of the present invention may be a white polyester support or may have a layer containing a white pigment under the silver halide emulsion layers. In order to further improve the sharpness of the image formed, it is desirable to make the photographic material have an antihalation layer on the support under the silver halide emulsion layers or on its back surface. In particular, it is desirable to make the support have a transmission density of from 0.35 to 0.8, in order that the display can be seen with any of reflected light and transmitted light.

The photographic material of the present invention can be exposed to any of visible rays and infrared rays. The exposure of the material can be effected by any of low-intensity exposure and high-intensity, short-time exposure. For the latter case, it is desirable to employ a laser-scanning exposure system where the exposure time is shorter than $10^{-4}$ second per one pixel.

To expose the photographic material of the present invention, it is desirable to employ a band-stop filter such as that described in U.S. Pat. No. 4,880,726, which prevents mixing of light to be applied to the material, thereby noticeably improving the color reproducibility of the material.

Next, the present invention is described in more detail by means of the following examples, which, however, are not intended to restrict the scope of the present invention.

EXAMPLE 1

Test for Solubility of Yellow Couplers in Organic Solvents:

A test was conducted in order to determine what grams of the yellow coupler shown in Table A below are dissolved in 100 ml of ethyl acetate at 25° C. The yellow coupler was gradually added to 100 ml of ethyl acetate by 0.1 g at a time and stirred for 5 minutes, whereupon the amount not dissolved was referred to as a saturation point. The results are shown in Table A. As comparative couplers, used were the following RY-1 and RY-2.

RY-1:

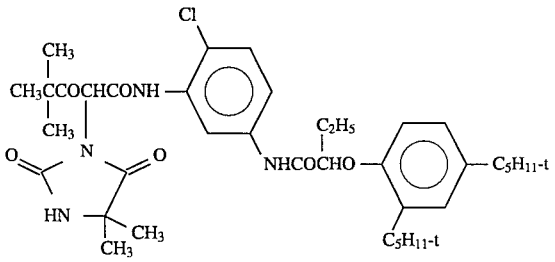

RY-2:

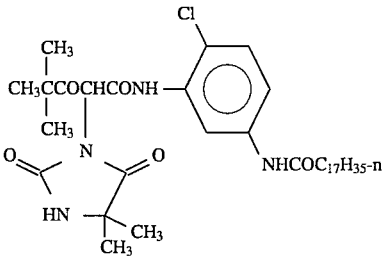

TABLE A

| Sample No. | Yellow Coupler | Solubility (Solubility of Couplers in 100 ml of Ethyl Acetate (at 25° C.)) | Remarks |
|---|---|---|---|
| 101 | RY-1 | 15.8 g/100 ml | comparative sample |
| 102 | RY-2 | 8.5 g/100 ml | comparative sample |
| 103 | Y-1 | 21.0 g/100 ml | sample of the invention |
| 104 | Y-2 | 21.2 g/100 ml | sample of the invention |
| 105 | Y-3 | 21.4 g/100 ml | sample of the invention |
| 106 | Y-13 | 20.8 g/100 ml | sample of the invention |

RY-1, RY-2, Y-1, Y-2, Y-3 and Y-13 are different from one another only in the part of $R_3$, but the yellow couplers of Y-1, Y-2, Y-3 and Y-13 of the present invention have a much larger solubility in ethyl acetate than the known yellow couplers of RY-1 and RY-2.

Since the yellow couplers of the present invention have such a large solubility in a solvent, it is possible to further improve the coloring property of the photographic material of the present invention containing the couplers and to reduce the thickness of the material thereby improving the sharpness thereof.

The same test as above was conducted to determine the solubility of the yellow couplers in known high boiling point organic solvents Solv-2, Solv-3 and Solv-9 mentioned below. As a result, it was found that the yellow couplers of Y-1, Y-2, Y-3 and Y-13 of the present invention have a much larger solubility in such solvents than the known yellow couplers of RY-1 and RY-2.

Solvent (Solv-2):

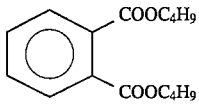

Solvent (Solv-3):

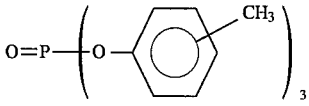

Solvent (Solv-9):

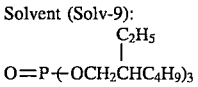

EXAMPLE 2

A paper support, of which the both surfaces had been laminated with polyethylene, was subjected to corona-discharging treatment, and then coated with a gelatin subbing layer containing sodium dodecylbenzenesulfonate. This was then coated with photographic layers mentioned below to be formed into a multi-layer color printing paper (201) having the layer constitution mentioned below. The coating liquids were prepared, as follows: Preparation of Coating Liquid for First Layer:

122.0 g of yellow coupler (RY-3), 7.5 g of color image stabilizer (Cpd-2), 16.7 g of color image stabilizer (Cpd-3) and 8.0 g of color image stabilizer (Cpd-5) were dissolved in 22 g of solvent (Solv-3), 22 g of solvent (Solv-9) and 180 ml of ethyl acetate, and the resulting solution was emulsified and dispersed in 1000 g of an aqueous 10% gelatin solution containing 86 ml of 10% sodium dodecylbenzenesulfonate to obtain an emulsified dispersion (A). On the other hand, prepared was a silver chlorobromide emulsion (A). The emulsion (A) was a 3/7 (by mol as silver) mixture of a large-size emulsion (A) comprising cubic grains having a mean grain size of 0.88 μm and a small-size emulsion (A) comprising cubic grains having a mean grain size of 0.70 μm. The large-size emulsion (A) and the small-size emulsion (A) had a fluctuation coefficient of the grain size distribution of 0.08 and 0.10, respectively. In the both emulsions, the base of each grain was silver chloride and the grains contained 0.3 mol% of silver bromide partly and locally on their surfaces. In the emulsion (A), the large-size emulsion (A) contained the following blue-sensitizing dyes (A), (B) and (C) of $8.0\times10^{-5}$ mol, per 1 mol of silver, each, while the small-size emulsion (A) contained them, $1.0\times10^{-4}$ mol each.

These emulsions were chemically ripened with a sulfur sensitizing agent and a gold sensitizing agent. The emulsified dispersion (A) previously prepared and this silver chlorobromide emulsion (A) were mixed to prepare a coating liquid for the first layer having the composition mentioned below. The amount of the emulsion coated corresponds to the amount of silver coated.

Coating liquids for the second layer to the seventh layer were prepared in the same manner as above. As the gelatin hardening agent in each layer, used was 1-oxy,-3,5-dichloro-s-triazine sodium salt.

Each layer contained (Cpd-12), (Cpd-13), (Cpd-14) and (Cpd-15) of 15.0 mg/m$^2$, 60.0 mg/m$^2$, 5.0 mg/m$^2$ and 10.0 mg/m$^2$, respectively.

The following spectral sensitizing dyes were added to the silver chlorobromide emulsions of the photosensitive emulsion layers.

Blue-sensitive Emulsion Layer:

Sensitizing Dye (A):

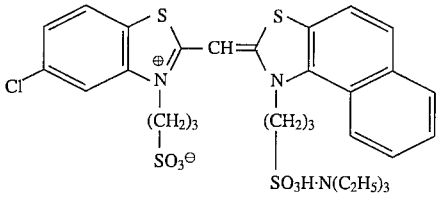

-continued

Sensitizing Dye (B):

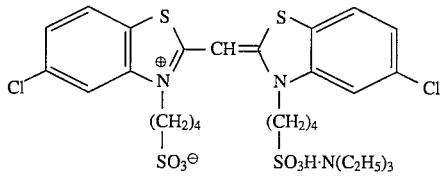

Sensitizing Dye (C):

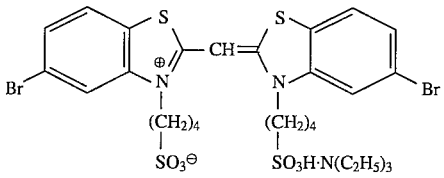

The large-size emulsion contained these sensitizing dyes of $1.4\times10^{-4}$ mol, per 1 mol of silver halide, each, while the small-size emulsion contained them, $1.7\times10^{-4}$ mol each.

Green-sensitive Emulsion Layer:

Sensitizing Dye (D):

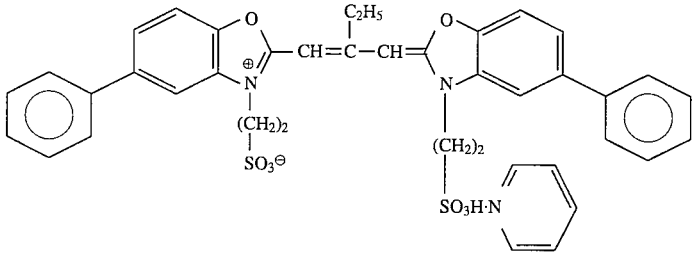

Sensitizing Dye (E):

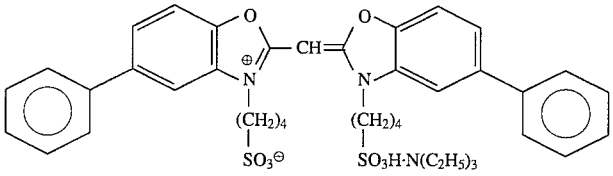

Sensitizing Dye (F):

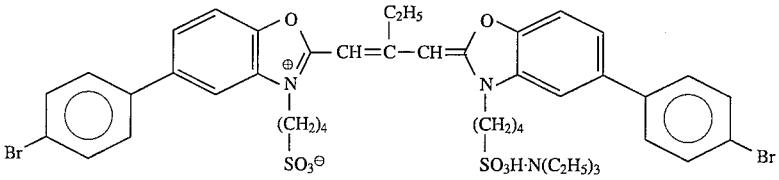

The large-size emulsion contained sensitizing dye (D) of $3.0\times10^{-4}$ mol, per 1 mol of silver halide, sensitizing dye (E) of $4.0\times10^{-5}$ mol and sensitizing dye (F) of $2.0\times10^{-4}$ mol, while the small-size emulsion contained (D) of $3.6\times10^{-4}$ tool, (E) of $7.0\times10^{-5}$ tool and (F) of $2.8\times10^{-4}$ mol.

Red-sensitive Emulsion Layer:

Sensitizing Dye (G):

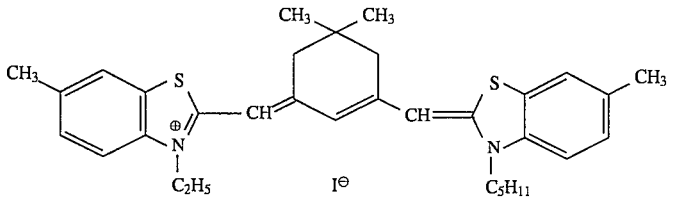

Sensitizing Dye (H):

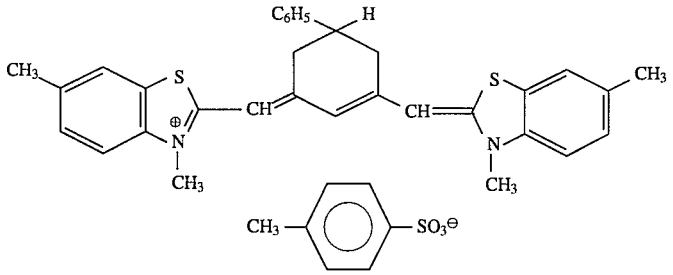

The large-size emulsion contained these sensitizing dyes of $5.0\times10^{-5}$ mol, per 1 mol of silver halide, each, while the small-size emulsion contained them, $8.0\times10^{-5}$ mols each.

In addition, the following compound of $2.6\times10^{-3}$ mol, per 1 mol of silver halide, was added to the red-sensitive emulsion layer.

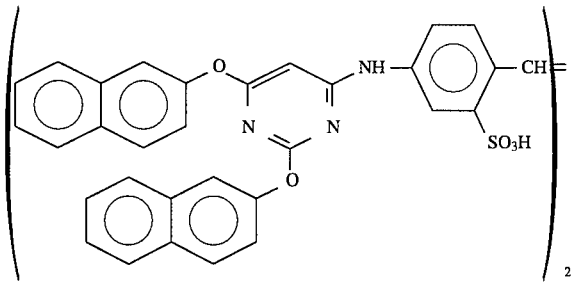

To the blue-sensitive emulsion layer, the green-sensitive emulsion layer and the red-sensitive emulsion layer, added was 1-(5-methylureidophenyl)-5-mercaptotetrazole of $3.3\times10^{-4}$ mol, $1.0\times10^{-3}$ mol and $5.9\times10^{-4}$ mol, per 1 mol of silver halide, respectively.

In addition, the compound was also added to the second layer, the fourth layer, the sixth layer and the seventh layer, at 0.2 mg/m$^2$, 0.2 mg/m$^2$, 0.6 mg/m$^2$ and 0.1 mg/m2, respectively.

To the blue-sensitive emulsion layer and the green-sensitive emulsion layer, added was 4-hydroxy-6-methyl-1,3,3a,7-tetrazaindene of $1\times10^{-4}$ mol and $2\times10^{-4}$ mol, per 1 mol of silver halide, respectively.

In addition, the following dyes (the parenthesized amounts corresponds to the amounts coated) were added to each emulsion layer for anti-irradiation.

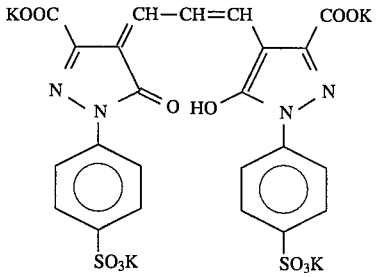

(10 mg/m$^2$)

and

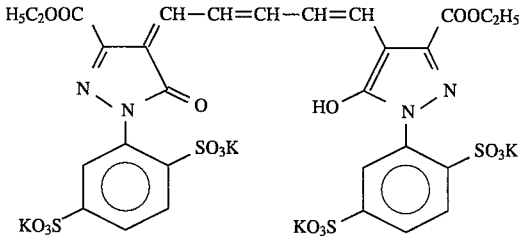

(40 mg/m$^2$)

Layer Constitution:

The constitution of the layers constituting the color printing paper is shown below. The numerals correspond to the amounts coated (g/m$^2$). The amount of the silver halide emulsion corresponds to the amount of silver coated.

Support:

Polyethylene laminated paper (This contained a white pigment ($TiO_2$ at a content of 15% by weight) and a bluish dye (ultramarine) in polyethylene under the first layer.)

| First Layer: Blue-sensitive Emulsion Layer | |
|---|---|
| Silver Chlorobromide Emulsion (A) mentioned above | 0.27 |
| Gelatin | 1.60 |
| Yellow Coupler (RY-3) | 0.61 |

| | |
|---|---|
| Color Image Stabilizer (Cpd-2) | 0.04 |
| Color Image Stabilizer (Cpd-3) | 0.08 |
| Color Image Stabilizer (Cpd-5) | 0.04 |
| Solvent (Solv-3) | 0.11 |
| Solvent (Solv-9) | 0.11 |
| Second Layer: Color Mixing Preventing Layer | |
| Gelatin | 0.99 |
| Color Mixing Preventing Agent (Cpd-4) | 0.10 |
| Solvent (Solv-1) | 0.07 |
| Solvent (Solv-2) | 0.20 |
| Solvent (Solv-3) | 0.15 |
| Solvent (Solv-7) | 0.12 |
| Third Layer: Green-sensitive Emulsion Layer | |
| Silver Chlorobromide Emulsion (This is a ⅓ (by mol as silver) mixture of a large-size emulsion (B) comprising cubic grains having a mean grain size of 0.55 μm and a small-size emulsion (B) comprising cubic grains having a mean grain size of 0.39 μm. The large-size emulsion (B) and the small-size emulsion (B) had a fluctuation coefficient of the grain size distribution of 0.10 and 0.08, respectively. In the both emulsions, the base of each grain was silver chloride and the grains contained 0.8 mol % of silver bromide partly and locally on their surfaces.) | 0.13 |
| Gelatin | 1.35 |
| Magenta Coupler (ExM-1) | 0.12 |
| Ultraviolet Absorbent (UV-1) | 0.12 |
| Color Image Stabilizer (Cpd-2) | 0.01 |
| Color Image Stabilizer (Cpd-5) | 0.01 |
| Color Image Stabilizer (Cpd-6) | 0.01 |
| Color Image Stabilizer (Cpd-7) | 0.08 |
| Color Image Stabilizer (Cpd-8) | 0.01 |
| Solvent (Solv-4) | 0.30 |
| Solvent (Solv-5) | 0.15 |
| Fourth Layer: Color Mixing Preventing Layer | |
| Gelatin | 0.72 |
| Color Mixing Preventing Agent (Cpd-4) | 0.07 |
| Solvent (Solv-1) | 0.05 |
| Solvent (Solv-2) | 0.15 |

| | |
|---|---|
| Solvent (Solv-3) | 0.12 |
| Solvent (Solv-7) | 0.09 |
| Fifth Layer: Red-sensitive Emulsion Layer | |
| Silver Chlorobromide Emulsion (This is a ¼ (by mol as silver) mixture of a large-size emulsion (C) comprising cubic grains having a mean grain size of 0.50 μm and a small-size emulsion (C) comprising cubic grains having a mean grain size of 0.41 μm. The large-size emulsion (C) and the small-size emulsion (C) had a fluctuation coefficient of the grain size distribution of 0.09 and 0.11, respectively. In the both emulsions, the base of each grain was silver chloride and the grains contained 0.8 mol % of silver bromide partly and locally on their surfaces.) | 0.18 |
| Gelatin | 0.80 |
| Cyan Coupler (ExC-1) | 0.28 |
| Ultraviolet Absorbent (UV-3) | 0.19 |
| Color Image Stabilizer (Cpd-1) | 0.24 |
| Color Image Stabilizer (Cpd-6) | 0.01 |
| Color Image Stabilizer (Cpd-8) | 0.01 |
| Color Image Stabilizer (Cpd-9) | 0.04 |
| Color Image Stabilizer (Cpd-10) | 0.01 |
| Solvent (Solv-1) | 0.01 |
| Solvent (Solv-6) | 0.21 |
| Sixth Layer: Ultraviolet Absorbing Layer | |
| Gelatin | 0.64 |
| Ultraviolet Absorbent (UV-2) | 0.39 |
| Color Image Stabilizer (Cpd-7) | 0.05 |
| Solvent (Solv-8) | 0.05 |
| Seventh Layer: Protective Layer | |
| Gelatin | 1.01 |
| Acryl-modified Copolymer of Polyvinyl Alcohol (having a degree of modification of 17%) | 0.04 |
| Liquid Paraffin | 0.02 |
| Surfactant (Cpd-11) | 0.01 |

The compounds used for preparing the color printing paper are shown below.

Megenta Coupler (ExM-1):

1/1 (by weight) mixture of

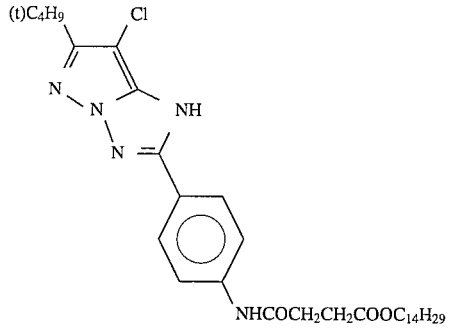

and

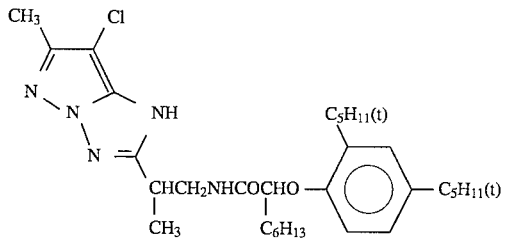

Cyan Coupler (ExC):

15/85 (by mol) mixture of

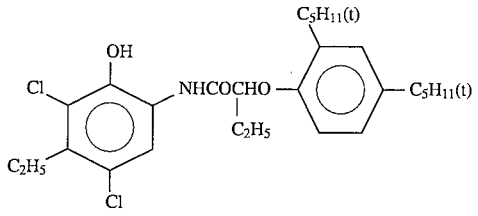

and

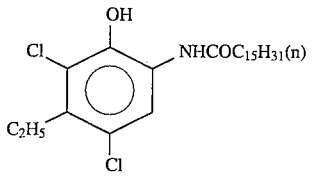

RY-1:
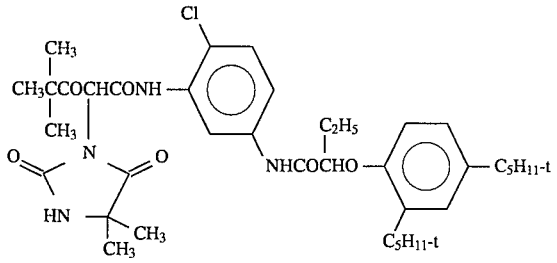
-continued
RY-2:
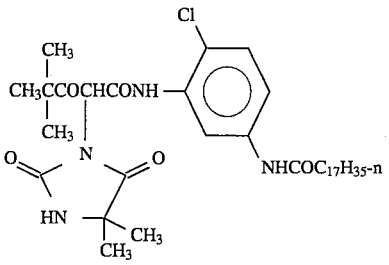
RY-3:
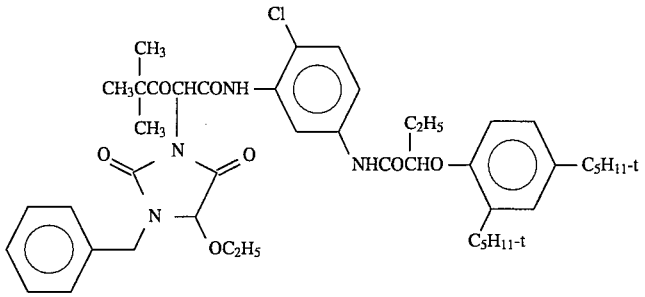
RY-4:
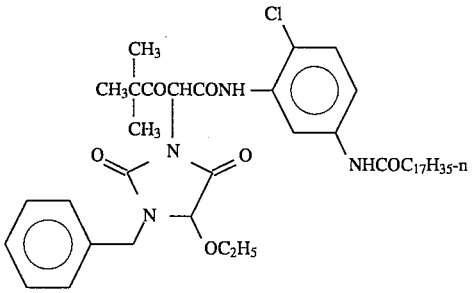
RY-5:
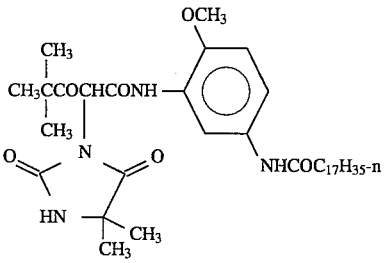
Solvent (Solv-1):
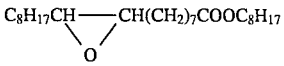
Solvent (Solv-2):
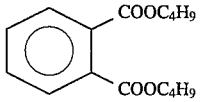
Solvent (Solv-3):
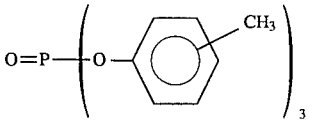
Solvent (Solv-4):
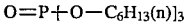
Solvent (Solv-5):
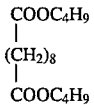
Solvent (Solv-6):
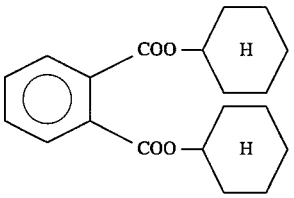
Solvent (Solv-7):
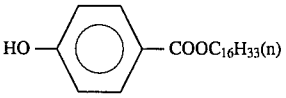
Solvent (Solv-8):
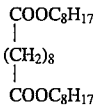

Solvent (Solv-9):

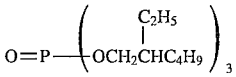

-continued

Color Image Stabilizer (Cpd-1):

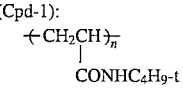

average molecular weight: 60000

Color Image Stabilizer (Cpd-2):

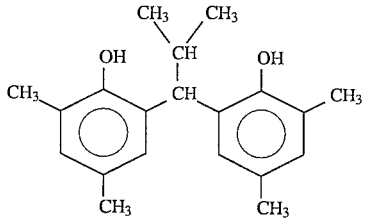

Color Image Stabilizer (Cpd-3):

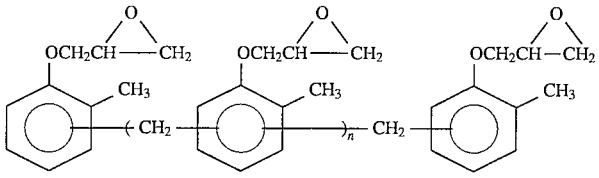

n = 7 to 8 (average)

Color Mixing Preventing Agent (Cpd-4):

1/1/1 (by weight) mixture of

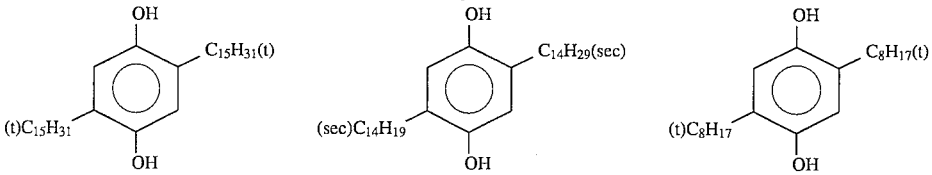

Color Image Stabilizer (Cpd-5):

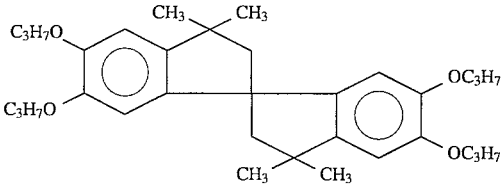

Color Image Stabilizer (Cpd-6):

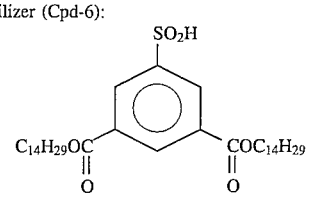

Color Image Stabilizer (Cpd-7):

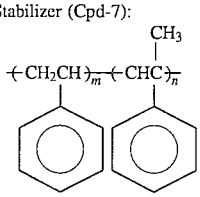

number average molecular weight: 600
m/n = 10/90

Color Image Stabilizer (Cpd-8):

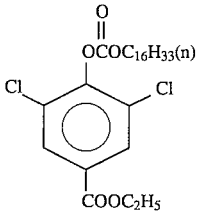

Color Image Stabilizer (Cpd-9):

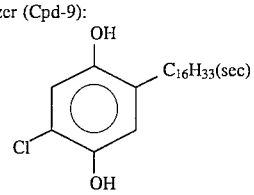

Color Image Stabilizer (Cpd-10):

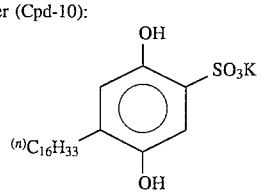

-continued
Surfactant (Cpd-11):
7/3 (by weight) mixture of
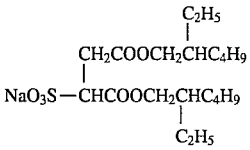
and
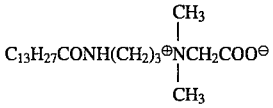
Antiseptic (Cpd-12):
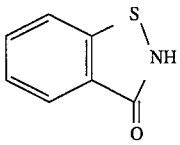
Antiseptic (Cpd-13):
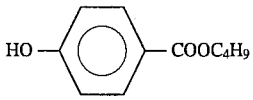
Antiseptic (Cpd-14):
1/1/1/1 (by weight) mixture of a, b, c and d
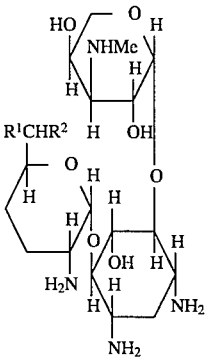
| | $R^1$ | $R^2$ |
|---|---|---|
| a | —Me | —NHMe |
| b | —Me | —$NH_2$ |
| c | —H | —$NH_2$ |
| d | —H | —NHMe |
Antiseptic (Cpd-15):
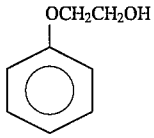
Ultraviolet Absorbent (UV-1):
1/3/4 (by weight) mixture of (1), (2) and (3)
(1)
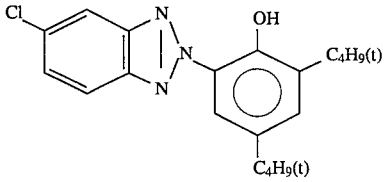
(2)
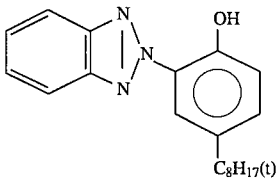
(3)
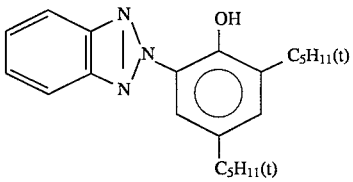
Ultraviolet Absorbent (UV-2):
1/2/2/3/1 (by weight) mixture of (1), (2), (3), (4) and (5)
(1)
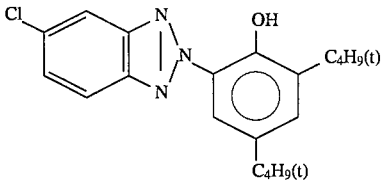
(2)
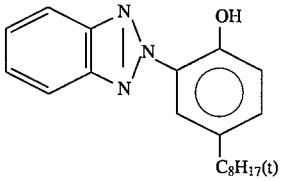
(3)
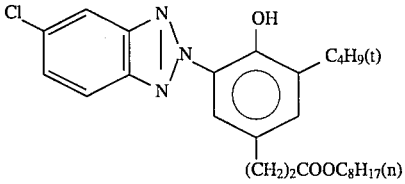
(4)
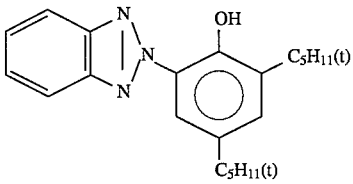

-continued (5)

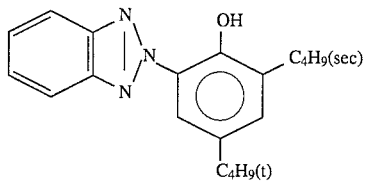

Ultraviolet Absorbent (UV-3):

1/3/2/1 (by weight) mixture of (1), (2), (3) and (4)

(1)

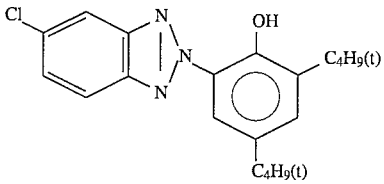

(2)

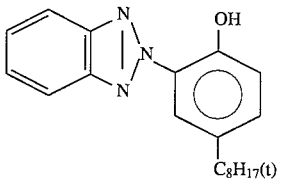

(3)

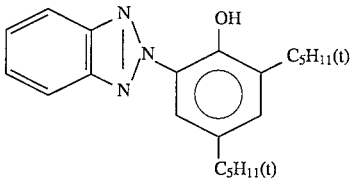

(4)

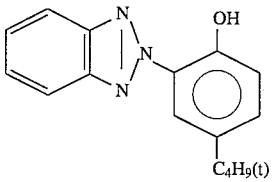

Samples Nos. 202 to 221 were prepared in the same manner as above, except that the yellow coupler (RY-3) in the first layer of Sample No. 201 was replaced by the same molar amount of the yellow coupler shown in Table B below. In Table B, (ExY-1) is a 91/4/2/3 (by mol) mixture of (Y-1), (Y-2), (Y-5) and (RY-2); (ExY-2) is a 1/1 (by mol) mixture of (Y-41) and (Y-42); and (ExY-3) is a 1/1 (by mol) mixture of (Y-43) and (Y-44).

The emulsions for these samples Nos. 201 to 221 were stored at 5° C for 30 hours. Using the thus-stored emulsions, samples Nos. 301 to 321 were prepared in the same manner as above.

These samples were exposed, using a sensitometer (FWH Model produced by Fuji Photo Film Co., having a color temperature of 3200 K at its light source), to such a degree that about 35% of silver coated was developed to give gray color.

50 $m^2$ of each of the thus-exposed samples were continuously processed, using a paper processor and according to the process mentioned below.

| Processing Steps | Temperature | Time | Amount of Replenisher (*) |
|---|---|---|---|
| Color Development | 38.5° C. | 45 sec | 73 ml |
| Blixation | 35° C. | 45 sec | 60 ml(**) |
| Rinsing (1) | 35° C. | 30 sec | — |
| Rinsing (2) | 35° C. | 30 sec | — |
| Rinsing (3) | 35° C. | 30 sec | 360 ml |
| Drying | 80° C. | 60 sec | |

(*) This is per 1 $m^2$ of the photographic material being processed.
(**) In addition to the indicated 60 ml, 120 ml, per 1 $m^2$ of the photographic material being processed, of the overflow from the rinsing tank (1) were introduced into the blixing tank.

The rinsing was conducted according to a three-tank counter-current cascade system from the rinsing tank (3) to the rinsing tank (1).

The processing solutions used in the processing steps are as follows:

| Color Developer: | Tank Solution | Replenisher |
|---|---|---|
| Water | 800 ml | 800 ml |
| Ethylenediaminetetraacetic Acid | 3.0 g | 3.0 g |
| Disodium 4,5-Dihydroxybenzene-1,3-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Whitening Agent (WHITEX 4, produced by Sumitomo Chemical Co.) | 1.0 g | 3.0 g |
| Sodium Sulfite | 0.1 g | 0.1 g |
| Disodium-N,N-bis(sulfonatoethyl) hydroxylamine | 5.0 g | 10.0 g |
| Sodium Triisopropylnaphthalene(β) sulfonate | 0.1 g | 0.1 g |
| N-ethyl-N-(β-methanesulfonamido-ethyl)-3-methyl-4-aminoaniline ½-Sulfate Mono-Hydrate | 5.0 g | 11.5 g |
| Water to make | 1000 ml | 1000 ml |
| pH (at 25° C., adjusted with potassium hydroxide and sulfuric acid) | 10.00 | 11.00 |

| Blixer: | Tank Solution | Replenisher |
|---|---|---|
| Water | 600 ml | 150 ml |
| Ammonium Thiosulfate (750 g/liter) | 93 ml | 230 ml |
| Ammonium Sulfite | 40 g | 100 g |
| Ammonium Ethylenediaminetetra-acetate/Iron(III) | 55 g | 135 g |
| Ethylenediaminetetraacetic Acid | 5 g | 12.5 g |
| Nitric Acid (67%) | 30 g | 65 g |
| Water to make | 1000 ml | 1000 ml |

-continued

| | | |
|---|---|---|
| pH (at 25° C., adjusted with acetic acid and aqueous ammonia) | 5.8 | 5.6 |

| Rinsing Solution: Tank solution and replenisher were the same. | |
|---|---|
| Sodium Chloroisocyanurate | 0.02 g |
| Deionized Water (having an electroconductivity of 5 μs/cm or less) | 1000 ml |
| pH | 6.5 |

Next, the samples were stepwise exposed to blue light and then processed with the same paper processor containing the processing liquids that had been used for the previous processing. The color density of each of the processed samples was measured in blue light, and the maximum yellow density Dmax was obtained. The results are shown in Table B.

TABLE B

| Sample No. | Yellow Coupler | Dmax (Coloring Property) | Sample No. | Emulsion Stored in Cool (at 5° C. for 30 days) Dmax | Remarks |
|---|---|---|---|---|---|
| 201 | RY-3 | 2.02 | 301 | 1.92 | comparative samples |
| 202 | RY-4 | 2.09 | 302 | 1.79 | comparative samples |
| 203 | RY-1 | 2.03 | 303 | 1.91 | comparative samples |
| 204 | RY-2 | 2.10 | 304 | 1.78 | comparative samples |
| 205 | RY-5 | 2.07 | 305 | 1.74 | comparative samples |
| 206 | Y-1 | 2.17 | 306 | 2.17 | samples of the invention |
| 207 | Y-2 | 2.17 | 307 | 2.16 | samples of the invention |
| 208 | Y-3 | 2.16 | 308 | 2.16 | samples of the invention |
| 209 | Y-4 | 2.15 | 309 | 2.14 | samples of the invention |
| 210 | Y-6 | 2.16 | 310 | 2.15 | samples of the invention |
| 211 | Y-7 | 2.15 | 311 | 2.14 | samples of the invention |
| 212 | Y-8 | 2.15 | 312 | 2.14 | samples of the invention |
| 213 | Y-9 | 2.14 | 313 | 2.12 | samples of the invention |
| 214 | Y-10 | 2.14 | 314 | 2.13 | samples of the invention |
| 215 | Y-12 | 2.14 | 315 | 2.12 | samples of the invention |
| 216 | Y-13 | 2.16 | 316 | 2.15 | samples of the invention |
| 217 | Y-14 | 2.15 | 317 | 2.14 | samples of the invention |
| 218 | ExY-1 | 2.17 | 318 | 2.17 | samples of the invention |
| 219 | ExY-2 | 2.16 | 319 | 2.14 | samples of the invention |
| 220 | ExY-3 | 2.15 | 320 | 2.14 | samples of the invention |
| 221 | Y-48 | 2.15 | 321 | 2.13 | samples of the invention |

As is obvious from the data in Table B above, the coloring property of the yellow couplers of the present invention is superior to that of the known yellow couplers, (RY-1) to (RY-5).

In addition, since the known yellow couplers have a low solubility in solvents, their coloring property (on the basis of Dmax) was noticeably worsened after having been stored at 5° C. for 30 days in cool. As opposed to these, however, the coloring property of the yellow couplers of the present invention was not almost worsened, even after having been stored under the same condition. From this, the high solubility of the yellow couplers of the present invention in solvents has been verified.

EXAMPLE 3

Samples Nos. 401 to 429 were prepared in the same manner as in preparation of sample No. 204, except that 0.20 g/m$^2$ of the amide compound shown in Table C below was added to the first layer. These samples were exposed to light of a fluorescent lamp of 80,000 luxes for 14 days, and the retentiveness of the color image at the initial density of 1.5 in each sample was obtained. In addition, the samples were stored at 80° C. and 70% RH for 20 days, and the retentiveness of the color image at the initial density of 1.5 in each sample was also obtained.

TABLE C

| Sample No. | Yellow Coupler | Amide Compound (0.20 g/m$^2$) | Xc | 80° C., 70% RH | Remarks |
|---|---|---|---|---|---|
| 401 | RY-2 | — | 65 | 67 | comparative sample |
| 402 | Y-1 | — | 75 | 77 | sample of the invention |
| 403 | Y-2 | — | 74 | 76 | sample of the invention |
| 404 | Y-3 | — | 74 | 75 | sample of the invention |
| 405 | Y-4 | — | 73 | 75 | sample of the invention |
| 406 | Y-13 | — | 75 | 76 | sample of the invention |
| 407 | ExY-1 | — | 75 | 77 | sample of the invention |
| 408 | ExY-2 | — | 74 | 76 | sample of the invention |
| 409 | ExY-3 | — | 73 | 76 | sample of the invention |
| 410 | Y-1 | S-1 | 88 | 89 | sample of the invention |
| 411 | Y-1 | S-2 | 85 | 86 | sample of the invention |
| 412 | Y-1 | S-4 | 87 | 88 | sample of the invention |
| 413 | Y-1 | S-5 | 85 | 86 | sample of the invention |
| 414 | Y-1 | S-9 | 84 | 85 | sample of the invention |
| 415 | Y-1 | S-18 | 83 | 84 | sample of the invention |
| 416 | Y-2 | S-1 | 87 | 87 | sample of the invention |
| 417 | Y-2 | S-4 | 86 | 87 | sample of the invention |
| 418 | Y-3 | S-1 | 87 | 86 | sample of the invention |
| 419 | Y-3 | S-4 | 86 | 85 | sample of the invention |
| 420 | Y-4 | S-1 | 86 | 87 | sample of the invention |
| 421 | Y-4 | S-4 | 85 | 86 | sample of the invention |
| 422 | Y-13 | S-1 | 86 | 85 | sample of the invention |
| 423 | Y-13 | S-4 | 85 | 84 | sample of the invention |
| 424 | ExY-1 | S-1 | 87 | 88 | sample of the invention |
| 425 | ExY-1 | S-4 | 86 | 87 | sample of the invention |
| 426 | ExY-2 | S-1 | 86 | 87 | sample of the invention |
| 427 | ExY-2 | S-4 | 85 | 86 | sample of the invention |
| 428 | ExY-1 | S-1 | 86 | 86 | sample of the invention |
| 429 | ExY-1 | S-4 | 84 | 86 | sample of the invention |

As is known from the data in Table C above, the couplers of the present invention have higher fastness to heat, moisture and light than the known yellow couplers. By adding the particular amide compound to the emulsion layer containing the yellow coupler of the present invention, the fastness to light, heat and moisture of the color image formed from the coupler is further improved. In particular, the addition of the diamide compound of formula (VI) is especially effective for improving the fastness of the color image.

As has been described in detail hereinabove, the yellow couplers of the present invention have a high solubility in solvents. Therefore, even though the emulsions containing the couplers are stored in cool for a long period of time, the coloring property of the couplers is not worsened. In addition, the fastness of the color images to be formed from the couplers is high.

While the invention has been described in detail and with reference to specific embodiments thereof, it will be apparent to one skilled in the art that various changes and modifications can be made therein without departing from the spirit and scope thereof.

What is claimed is:

1. A photographic yellow dye-forming coupler represented by formula (I)

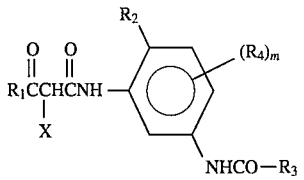

(I)

wherein $R_1$ represents an alkyl group, a cycloalkyl group, an aryl group, an alkylamino group, an anilino group, or a heterocyclic group; $R_2$ represents a hydrogen atom, a halogen atom, an aliphatic-oxy group, an aryloxy group, an aliphatic group, or an amino group; $R_3$ represents an alkenyl group; $R_4$ represents a substituent; m represents an integer of from 0 to 3; and X represents a hydrogen atom, or a group capable of being split off from the formula by the coupling reaction with an oxidation product of an aromatic primary amine developing agent.

2. A silver halide color photographic material comprising a support having provided thereon at least one light-sensitive silver halide emulsion layer and at least one light-insensitive hydrophilic colloid layer, wherein at least one of the light-sensitive silver halide emulsion layer and the light-insensitive hydrophilic colloid layer contains at least one photographic yellow dye-forming coupler represented by formula (I)

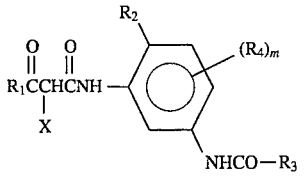

(I)

wherein $R_1$ represents an alkyl group, a cycloalkyl group, an aryl group, an alkylamino group, an anilino group, or a heterocyclic group; $R_2$ represents a hydrogen atom, a halogen atom, an aliphaticoxy group, an aryloxy group, an aliphatic group, or an amino group; $R_3$ represents an alkenyl group; $R_4$ represents a substituent; m represents an integer of from 0 to 3; and X represents a hydrogen atom, or a group capable of being split off from the formula by the coupling reaction with an oxidation product of an aromatic primary amine developing agent.

3. The silver halide color photographic material as claimed in claim 2, wherein $R_3$ is represented by formula (II)

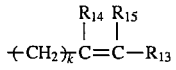

(II)

wherein $R_{13}$ represents a hydrogen atom, an alkyl group, or an alkenyl group; $R_{14}$ and $R_{15}$ each independently represents a hydrogen atom, a chlorine atom, or a bromine atom; and k represents an integer of from 3 to 11.

4. The silver halide color photographic material as claimed in claim 2, wherein X is represented by formula III-1)

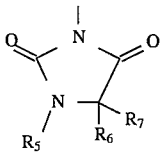

(III-1)

wherein $R_5$, $R_6$ and $R_7$ each independently represents a hydrogen atom, or an alkyl group having from 1 to 4 carbon atoms.

5. The silver halide color photographic material as claimed in claim 2, wherein said at least one layer further contains a compound represented by formula (IV)

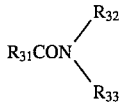

(IV)

wherein $R_{31}$, $R_{32}$ and $R_{33}$ each independently represents a hydrogen atom, an aliphatic group or an aryl group, provided that the sum of the carbon atoms constituting the groups of $R_{31}$, $R_{32}$ and $R_{33}$ is from 9 to 80.

6. The photographic yellow dye-forming coupler as claimed in claim 1, wherein $R_2$ is a halogen atom.

7. The silver halide color photographic material as claimed in claim 2, wherein $R_2$ is a halogen atom.

8. The silver halide color photographic material as claimed in claim 3, wherein $R_{14}$ and $R_{15}$ each represents a hydrogen atom.

9. The silver halide color photographic material as claimed in claim 3, wherein $R_{13}$ is an alkyl group.

10. The silver halide color photographic material as claimed in claim 3, wherein k is 7.

11. The photographic yellow-dye forming coupler as claimed in claim 1, wherein $R_3$ is an oleyl group.

12. The silver halide color photographic material as claimed in claim 2, wherein $R_3$ is an oleyl group.

13. The photographic yellow-dye forming coupler as claimed in claim 1, wherein $R_1$ is a t-butyl group.

14. The silver halide color photographic material as claimed in claim 2, wherein $R_1$ is a t-butyl group.

15. The silver halide color photographic material as claimed in claim 2, wherein the photographic yellow-dye forming coupler represented by formula (I) is contained in an amount of 0.01 to 10 mmol per 1 m2 of the photographic material.

16. The silver halide color photographic material as claimed in claim 5, wherein the compound represented by formula (IV) is represented by formula (V)

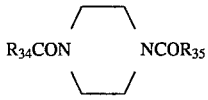

(V)

wherein $R_{34}$ and $R_{35}$ each have the same meaning as $R_{31}$ in formula (IV), and the sum of the carbon atoms constituting $R_{34}$ and $R_{35}$ is from 12 to 75.

17. The silver halide color photographic material as claimed in claim 16, wherein both $R_{34}$ and $R_{35}$ are the same, and represent the branched alkyl groups represented by formula (VI)

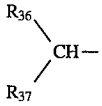

(VI)

wherein $R_{36}$ represents a linear or branched alkyl group having from 4 to 13 carbon atoms; and $R_{37}$ represents a linear or branched alkyl group having from 2 to 11 carbon atoms.

18. The silver halide color photographic material as claimed in claim 17, wherein $R_{36}$ is an branched alkyl group having 9 to 10 carbon atoms, and $R_{37}$ is an branched alkyl group having 7 to 8 carbon atoms.

19. The silver halide color photographic material as claimed in claim 17, wherein $R_{36}$ is an branched alkyl group having 9 carbon atoms, and $R_{37}$ is an branched alkyl group having 7 carbon atoms.

20. The silver halide color photographic material as claimed in claim 5, wherein the compound represented by formula (IV) is contained in an amount of 0.0002 to 20 g per 1 $m^2$ of the photographic material.

21. The silver halide color photographic material as claimed in claim 2, wherein said yellow dye-forming coupler is contained in said light-sensitive silver halide emulsion layer.

22. The silver halide color photographic material as claimed in claim 21, wherein said light-sensitive silver halide emulsion layer containing said yellow dye-forming coupler is sensitive to blue light, and said material further comprises on said support a green-sensitive silver halide emulsion layer and a red-sensitive silver halide emulsion layer.

* * * * *